US012539469B2

(12) United States Patent
Sheltman et al.

(10) Patent No.: US 12,539,469 B2
(45) Date of Patent: Feb. 3, 2026

(54) TOY VEHICLE TRACK WITH LIFT, RELEASE AND STUNT APPARATUSES

(71) Applicant: SPIN MASTER LTD., Toronto (CA)

(72) Inventors: David Sheltman, Los Angeles, CA (US); Eli Halpert, Los Angeles, CA (US); Liliana Sanchez Bravo, Long Beach, CA (US); Adrian Kwan, Los Angeles, CA (US)

(73) Assignee: SPIN MASTER LTD., Toronto (CA)

( * ) Notice: Subject to any disclaimer, the term of this patent is extended or adjusted under 35 U.S.C. 154(b) by 152 days.

(21) Appl. No.: 18/476,725

(22) Filed: Sep. 28, 2023

(65) Prior Publication Data

US 2024/0108996 A1 Apr. 4, 2024

(30) Foreign Application Priority Data

Sep. 29, 2022 (CA) ..... 3177813

(51) Int. Cl.
*A63H 18/04* (2006.01)
*A63H 18/02* (2006.01)
*A63H 18/06* (2006.01)

(52) U.S. Cl.
CPC ..... *A63H 18/021* (2013.01); *A63H 18/026* (2013.01); *A63H 18/028* (2013.01); *A63H 18/04* (2013.01); *A63H 18/06* (2013.01)

(58) Field of Classification Search
CPC ..... A63H 18/00; A63H 18/02; A63H 18/04
See application file for complete search history.

(56) References Cited

U.S. PATENT DOCUMENTS 1,604,294 A 10/1926 Marx
3,542,366 A * 11/1970 Schocker ..... A63H 18/028 273/108

(Continued)

FOREIGN PATENT DOCUMENTS

CN 212467124 U 2/2021
GB 2482804 A 2/2012
JP 2007075495 A 3/2007

OTHER PUBLICATIONS

Hot Wheels Toy Car Track Builder Track Vertical Launch Kit Playset & 1:64 Scale Vehicle, 50 inches Tall with 36 Component Parts. Jun. 2023, retrieved from: https://www.canadiantire.ca/en/pdp/hot-wheels-track-builder-vertical-launch-kit-0506624p.html?msockid=3e47de63e6d46a9423e4cbb5e7536b26.

(Continued)

*Primary Examiner* — John A Ricci
(74) *Attorney, Agent, or Firm* — Aird & McBurney LP

(57) ABSTRACT

A toy vehicle track system includes a lifting apparatus, a releasing apparatus, and a stunt apparatus. The lifting apparatus includes a drive wheel rotatable to pull a carrier line attached to a carrier including a vehicle holder that is positioned for holding a toy vehicle. The release apparatus includes a stop structure attached to the track that engages the carrier to actuate calipers of the vehicle holder to release the vehicle. The stunt apparatus includes a plurality of stunt track segments attached to a rotary indexer. The rotary indexer allows the stunt track segments to be rotated about an axis that is substantially parallel to a travel direction defined by the toy track to align each of the stunt track segments individually with the toy track to form a continuous travel path.

18 Claims, 19 Drawing Sheets

(56) References Cited

U.S. PATENT DOCUMENTS 4,357,778 A * 11/1982 Matsumoto ..... A63H 18/04 446/444
4,728,312 A * 3/1988 Ohnuma ..... A63H 18/04 446/314
6,508,179 B2 * 1/2003 Annis ..... A63H 18/04 104/53
7,549,906 B2 * 6/2009 Bedford ..... A63H 18/08 104/54
7,628,674 B2 * 12/2009 Nuttall ..... A63H 18/026 446/444
7,770,811 B2 * 8/2010 Belding ..... A63H 18/08 104/56
7,819,720 B2 * 10/2010 Nuttall ..... A63H 18/028 446/444
7,946,903 B2 * 5/2011 Sheltman ..... A63H 18/06 446/168
8,323,069 B2 * 12/2012 Nuttall ..... A63H 18/08 446/444
8,449,344 B2 * 5/2013 Nuttall ..... A63H 18/023 446/75
8,567,690 B2 * 10/2013 De La Torre ..... A63H 18/028 446/444
8,944,882 B2 * 2/2015 O'Connor ..... F16M 13/022 238/10 R
9,314,705 B2 * 4/2016 Payne ..... A63H 18/10
9,421,473 B2 * 8/2016 Ostendorff ..... A63H 18/023
9,586,154 B2 * 3/2017 Lau ..... A63H 18/14
10,213,702 B2 2/2019 Lennon
10,265,634 B2 * 4/2019 Daly ..... A63H 18/028
2005/0287918 A1 * 12/2005 Sheltman ..... A63H 18/028 446/444
2012/0220183 A1 * 8/2012 Payne ..... A63H 18/00 446/14
2014/0097263 A1 4/2014 Ostendorff
2015/0122903 A1 5/2015 Boyce et al.
2017/0106303 A1 4/2017 O'Connor
2017/0252660 A1 * 9/2017 Jungco ..... A63H 19/34
2018/0229137 A1 * 8/2018 Martinez ..... A63H 18/028

OTHER PUBLICATIONS

CA patent application No. 3177813—Examiner's report dated Apr. 3, 2024.

* cited by examiner

TOY VEHICLE TRACK WITH LIFT, RELEASE AND STUNT APPARATUSES

CROSS-REFERENCE TO RELATED APPLICATIONS

The present application claims the benefit of Canadian Patent Application No. 3,177,813 filed Sep. 29, 2022, the contents of which are incorporated herein in their entirety.

FIELD

The present disclosure relates to toy tracks for toy vehicles, and more particularly to systems for lifting a toy vehicle on a vertically extending toy track, releasing the toy vehicle on the toy track, and selecting a stunt track segment for the toy track.

BACKGROUND OF THE DISCLOSURE

The prior art includes examples of toy tracks for toy vehicles: U.S. Pat. No. 3,542,366 (Schocker; Nov. 24, 1970); U.S. patent application publication no. 2005/0287918 A1 (Sheltman et al.; Dec. 29, 2005); U.S. Pat. No. 7,628,674 (Nuttall et al.; Dec. 8, 2009); U.S. patent application publication no. 2012/0220183 A1 (Payne; Aug. 30, 2012); U.S. Pat. No. 8,449,344 (Nuttall et al.; May 28, 2013); U.S. Pat. No. 8,567,690 (De La Torre; Oct. 29, 2013); U.S. Pat. No. 8,944,882 (O'Connor et al.; Feb. 3, 2015); U.S. Pat. No. 9,314,705 (Payne et al.; Apr. 19, 2016); U.S. Pat. No. 9,586,154 (Lau et al.; Mar. 7, 2017); and U.S. patent application publication no. 2018/0229137 A1 (Martinez et al.; Aug. 16, 2018).

U.S. Pat. No. 7,770,811 (Belding; Aug. 10, 2010), U.S. Pat. No. 7,946,903 (Sheltman; May 24, 2011), and U.S. Pat. No. 10,265,634 (Daly et al.; Apr. 23, 2019) disclose toy vehicle tracks with vertically extending segments. The Hot Wheels™ Track Builder Vertical Launch Kit, model no. GGH70 (Mattel, Inc., USA) includes a toy track with a vertical segment that is removably secured to a wall using Command Strips™ (3M Company; USA).

A child at the age of six years old typically has a maximum reach of about 4 feet (3.7 meters). It would be desirable for such child to able to place a toy vehicle on and release the toy vehicle from the vertical track segment at a height beyond the child's reach.

U.S. Pat. No. 7,819,720 (Nuttall et al.; Oct. 26, 2010), and U.S. Pat. No. 8,323,069 (Nuttall et al.; Dec. 4, 2012) disclose a toy vehicle track with an indexing stunt selector having a first stunt element (i.e., a track segment) disposed in the vehicle pathway to cause a toy vehicle to perform a stunt. The stunt selector includes a turntable-like rotating element that rotates the stunt elements about a vertical axis that is perpendicular to the horizontal travel direction of the track for aligning one of the stunt elements with the remainder of the track. The Monster Jam™ Stunt Dial Playset, model no. 6060862 (Spin Master Corp.) includes a toy vehicle launcher and an indexing stunt selector. The stunt selector includes a Ferris wheel-like rotating element that rotates various stunt elements (i.e., track segments) about a horizontal axis that is perpendicular to the horizontal travel direction of the track for aligning one of the stunt elements with the remainder of the track.

Such stunt selectors require a substantial horizontal footprint or vertical clearance beyond the track surface to accommodate the rotation of the stunt elements. It would be desirable for stunt selectors to have a more compact configuration.

SUMMARY OF THE DISCLOSURE

In a first aspect, the present disclosure provides a lifting apparatus for lifting a toy vehicle along a segment of a toy track. The lifting apparatus includes a carrier, a drive wheel, a carrier line, and a one-way clutch. The carrier includes a vehicle holder that is positioned for holding the toy vehicle, is movable toward the upper end of the segment of the toy track, and is releasably connectable to the toy vehicle. The drive wheel is rotatable relative to the segment of the toy track. The carrier line is attached to the carrier and is engageable with the drive wheel such that rotation of the drive wheel in a first drive wheel direction drives the carrier line to travel in a first carrier line direction so as to lift the carrier and the toy vehicle towards the upper end of the segment. The one-way clutch is positionable in a release position to permit of the carrier line to move in the first drive wheel direction so as to permit lifting of the carrier. The one-way clutch is also positionable in a holding position to resist movement of the carrier line in a second carrier line direction that is opposite to the first carrier line direction so as to hold the carrier against dropping.

In embodiments of the lifting apparatus, the lifting apparatus further includes a support member that supports either the drive wheel or the toy track, or both. In embodiments, the support member bears against a vertical surface, such as a wall or a door. At least part of the drive wheel is disposed horizontally between the segment of the toy track and the vertical surface.

In embodiments of the lifting apparatus, the lifting apparatus further includes a support member that rotatably supports the drive wheel. In embodiments, the segment of the toy track is supported on a horizontal surface, and the support member does not contact the horizontal surface. In embodiments, the support member may at least partially support the toy track. In embodiments, the support member is removably attached to a vertical surface adjacent to the segment of the toy track. The support member may include a first part that includes a planar surface that is removably attached to the vertical surface, and a second part extending horizontally from the first part and releasably attached by interference fit to the first part. The support member may be removably attached to the vertical surface by stretch releasing adhesive tape.

In embodiments of the lifting apparatus, the lifting apparatus further includes a handle for manually rotating the drive wheel.

In embodiments of the lifting apparatus, the lifting apparatus further includes segment of the toy track, and the toy track defines a gap for receiving the carrier line.

In embodiments of the lifting apparatus, the drive wheel includes a ratchet wheel, and the one-way clutch includes a pawl.

In a second aspect, the present disclosure provides a releasing apparatus for releasing a toy vehicle on a segment of a toy track having an upper end. The releasing apparatus includes a carrier, and a stop structure. The carrier movable towards the upper end of the segment of the toy track, and includes a vehicle holder including a pair of calipers includes opposed vehicle engagement surfaces. The calipers are pivotable in relation to each other to vary the calipers between a vehicle-holding configuration and a vehicle-releasing configuration. In the vehicle-holding configuration, the vehicle engagement surfaces clamp the toy vehicle between the vehicle engagement surfaces to hold the toy vehicle. In the vehicle-releasing configuration, the vehicle engagement surfaces disengage from the toy vehicle to release the toy vehicle. The stop structure is attached to the toy track, and includes at least one caliper-actuating member. In use, when the carrier moves toward the upper end of the segment of the toy track relative to the stop structure (i.e. when the carrier 40 reaches the, the at least one caliper-actuating member engages at least one of the calipers to urge the calipers from the vehicle-holding configuration to the vehicle-releasing configuration.

In embodiments of the releasing apparatus, the at least one caliper-actuating member includes a pair of caliper-actuating members, and wherein, in use, each one of the caliper-actuating members engages a different one of the calipers to urge the calipers from the vehicle-holding configuration to the vehicle-releasing configuration.

In embodiments of the releasing apparatus, the toy vehicle includes a pair of wheels, and each of calipers defines a shoulder for engaging one of the wheels.

In embodiments of the releasing apparatus, the stop structure is translatable along the segment of the toy track to vary a position of the stop structure along the segment of the toy track. The stop structure may include a cam lever pivotable relative to the segment of the toy track between: a lock position in which the cam lever engages the segment of the toy track to prevent translation of the stop structure along the track; and an unlock position in which the cam lever disengages from the segment of the toy track to allow translation of the stop structure along the track. The stop structure may further include a key member movable relative to the cam lever between: a lock position in which the key member interferes with the cam lever to prevent the cam lever from pivoting from the lock position to the unlock position; and an unlock position in which the key member permits the cam lever to pivot from the lock position to the unlock position.

In embodiments of the releasing apparatus, the releasing apparatus further includes a drive wheel, a carrier line, and a one-way clutch, and optionally a support member and other features of the lifting apparatus of the first aspect and embodiments thereof, as described above In a third aspect, the present disclosure provides a stunt selection apparatus for selecting a stunt for a toy vehicle on a toy track defining a travel direction for the toy vehicle. The stunt apparatus includes a plurality of stunt track segments, and a rotary indexer. Each of the stunt track segments is adapted to induce a motion of the toy vehicle that is different from the motion of the toy vehicle induced by the other one of the stunt track segments. The rotary indexer is attached to the stunt track segments, and is for rotating the stunt track segments about an axis that is substantially parallel to the travel direction defined by the toy track, to selectively align each one of the stunt track segments individually with the toy track such that the aligned one of the stunt track segments and the toy track form a continuous travel path for the toy vehicle.

In embodiments of the stunt apparatus, the plurality of stunt track segments may include at least three stunt track segments. The rotary indexer may further includes a knob for manually rotating the stunt track segments about the axis.

Embodiments of the apparatuses of the first, second, or third aspects, may include or be combined with features of any embodiment of the apparatus of any of the other aspects, as described above.

BRIEF DESCRIPTIONS OF THE DRAWINGS

For a better understanding of the various embodiments described herein and to show more clearly how they may be carried into effect, reference will now be made, by way of example only, to the accompanying drawings in which:

FIG. 4 is a front perspective view of the vehicle holder of the carrier in a vehicle-receiving configuration, while engaging the stop structure;

FIG. 5 is a front perspective view of the vehicle holder of the carrier in a vehicle-receiving configuration;

FIG. 6 is a front perspective view of the vehicle holder of the carrier in a vehicle-holding configuration, while holding a toy vehicle;

FIG. 7 is a front perspective view of the vehicle holder of the carrier in a vehicle-holding configuration, and approaching a stop member, while holding a toy vehicle;

FIG. 8 is a top perspective view of the vehicle holder of the carrier in a vehicle-holding configuration, and initially engaging the stop member, while holding a toy vehicle;

FIG. 15 is a left perspective view of the stunt apparatus;

FIG. 16 is a right perspective view of the stunt apparatus;

FIG. 17 is a top front perspective view of the stunt apparatus;

FIG. 18 shows the stunt apparatus in a first orientation;

FIG. 19 shows the stunt apparatus in a second orientation;

FIG. 20 shows the stunt apparatus in a third orientation;

FIG. 22 shows a stunt track segment for inducing a high arc jumping motion;

FIG. 23 shows a stunt track segment for inducing a forward somersault motion;

FIG. 24 shows a stunt track segment for inducing a barrel roll motion;

FIG. 25 shows the rotary indexer in a first orientation; and

FIG. 26 shows the rotary indexer in a second orientation.

DETAILED DESCRIPTION

Interpretation

Figure 1:
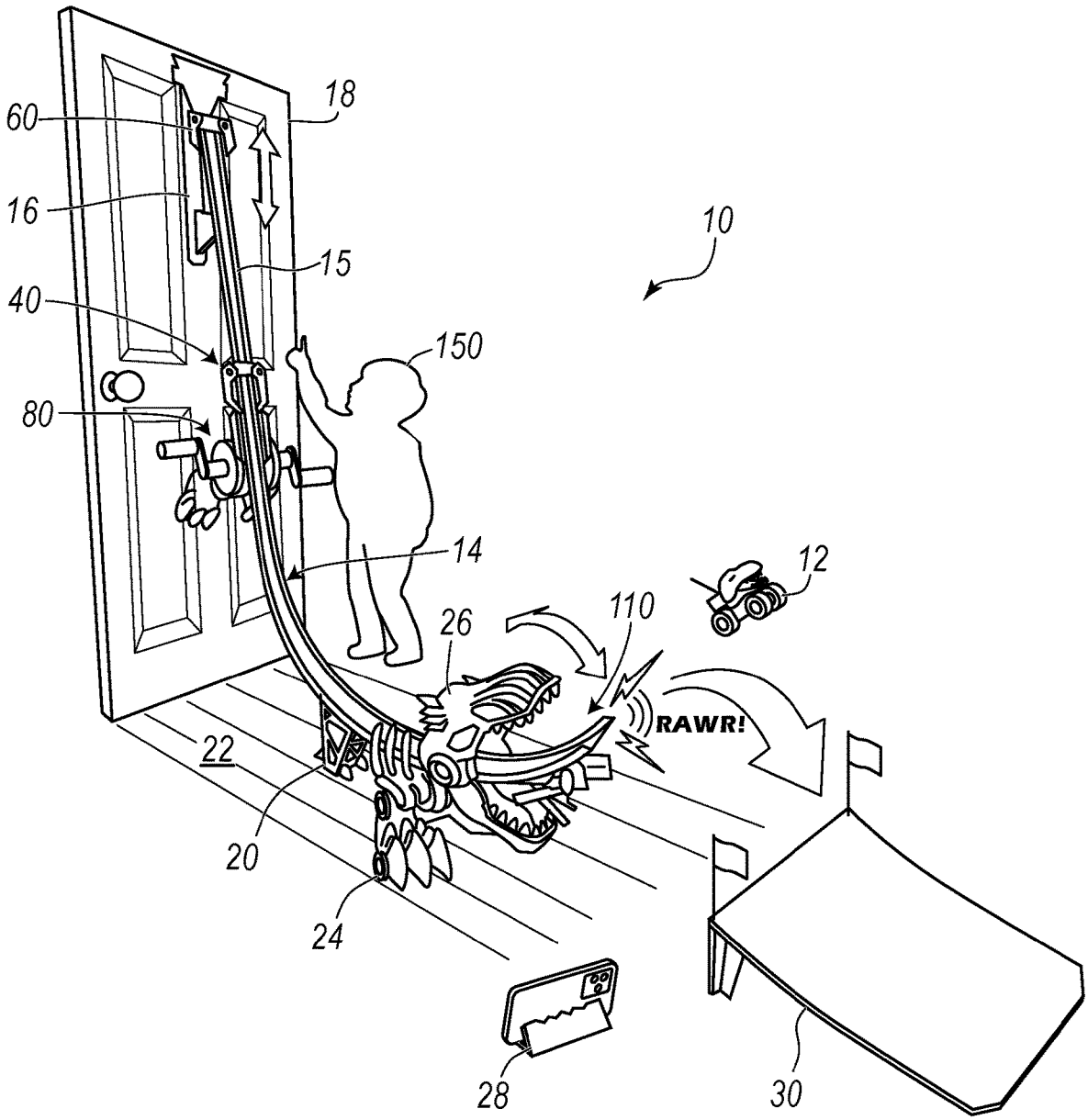
FIG. 1 is a front left perspective view of an embodiment of a toy track system of the present disclosure.
Figure 2:
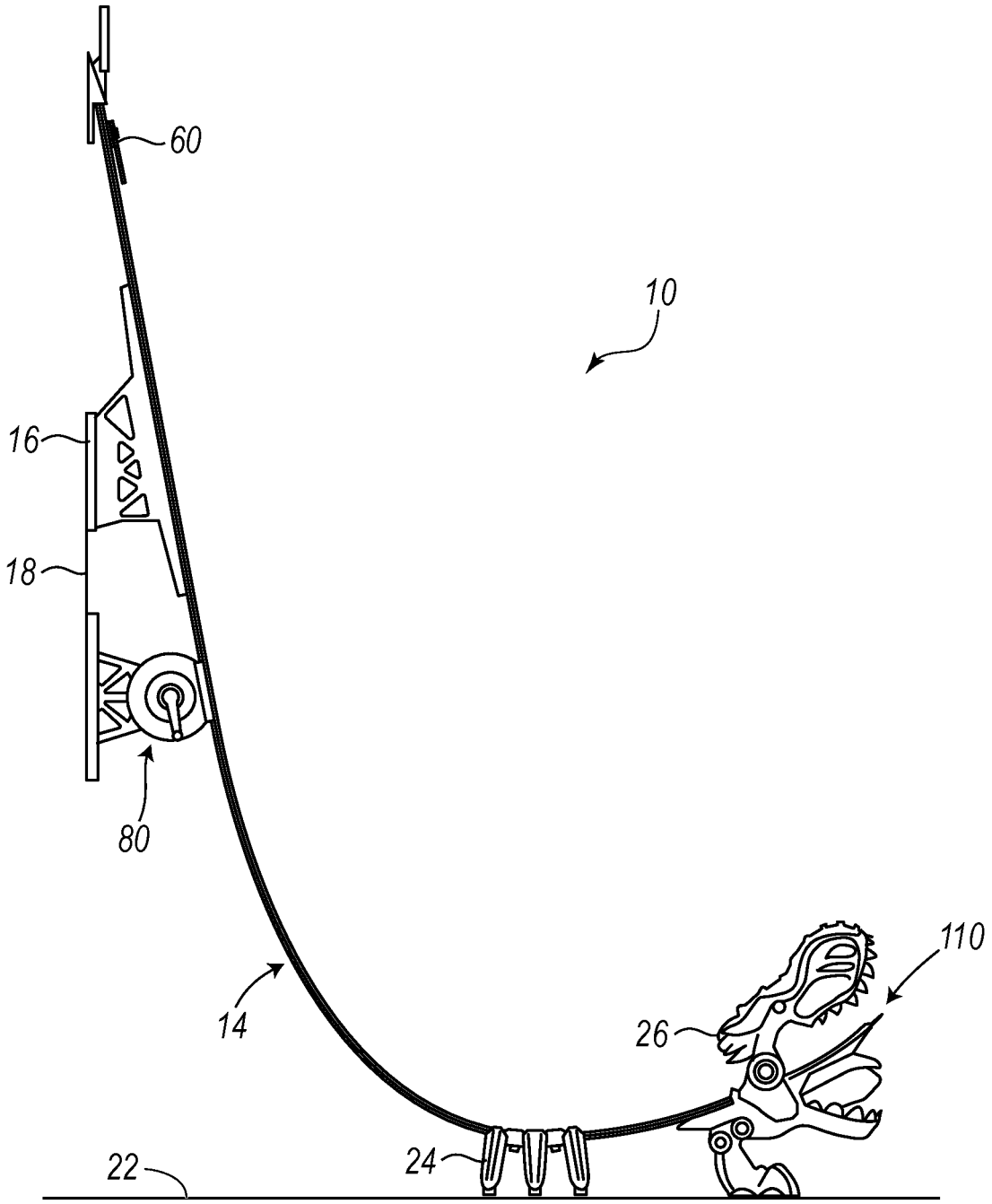
FIG. 2 is a left side elevation view of the system of FIG. 1.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

As used in this document, "attached" in describing the relationship between two connected parts includes the case in which the two connected parts are "directly attached" with the two connected parts being in contact with each other, and the case in which the connected parts are "indirectly attached" and not in contact with each other, but connected by one or more intervening other part(s) between.

The embodiments of the inventions described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the invention, therefore, is only to be limited by the claims appended hereto and any amendments made thereto.

Toy Track System

FIG. 1 shows a system 10 of the present disclosure for use with a toy vehicle 12 that that travels on a toy track 14. The toy vehicle 12 may be a wheeled toy vehicle, such as a toy truck in the embodiment shown, and may therefore have a plurality of wheels 13, including a plurality of rear wheels 204 and a plurality of front wheels 206. The track 14 includes a segment 15 having an upper end. The segment is vertically extending. As used herein, "vertically extending" refers to the track 14 being oriented at a non-zero angle relative horizontal, such as about 80 degrees from the horizontal in the embodiment shown. An upper support member 16 supports the track 14 against a vertical surface 18 such as a wall or a door. A first lower support member 20 supports an intermediate portion of the track 14 on a horizontal surface 22 such as a floor or a table top. A second lower support member 24, in the form of stylized dinosaur feet, supports an end of the track 14 on the horizontal surface 22. In other embodiments, the track 14 may be "free standing"—i.e. supported entirely on the horizontal surface 22 such as a floor or a table top, without the need for support against a vertical surface such as a wall or a door. A stylized dinosaur head 26 houses batteries that power light-emitting diodes (LEDs) for generating lighting effects, a speaker for generating sound effects, and a motor for generating movements of the dinosaur head 26 to trap the toy vehicle 12. Accessories of the system 10 include a landing ramp 28, and a smart phone holder 30. The system 10 includes a carrier 40, a stop structure 60, a lifting apparatus 80, and a stunt apparatus 110, as described below.

Carrier

With reference to FIGS. 4-9, a purpose of the carrier 40 is to hold the vehicle 12 as the carrier 40 is lifted along the track 14. Another purpose of the carrier 40 is to release the vehicle 12 when the carrier 40 engages the stop structure 60.

Figure 4:
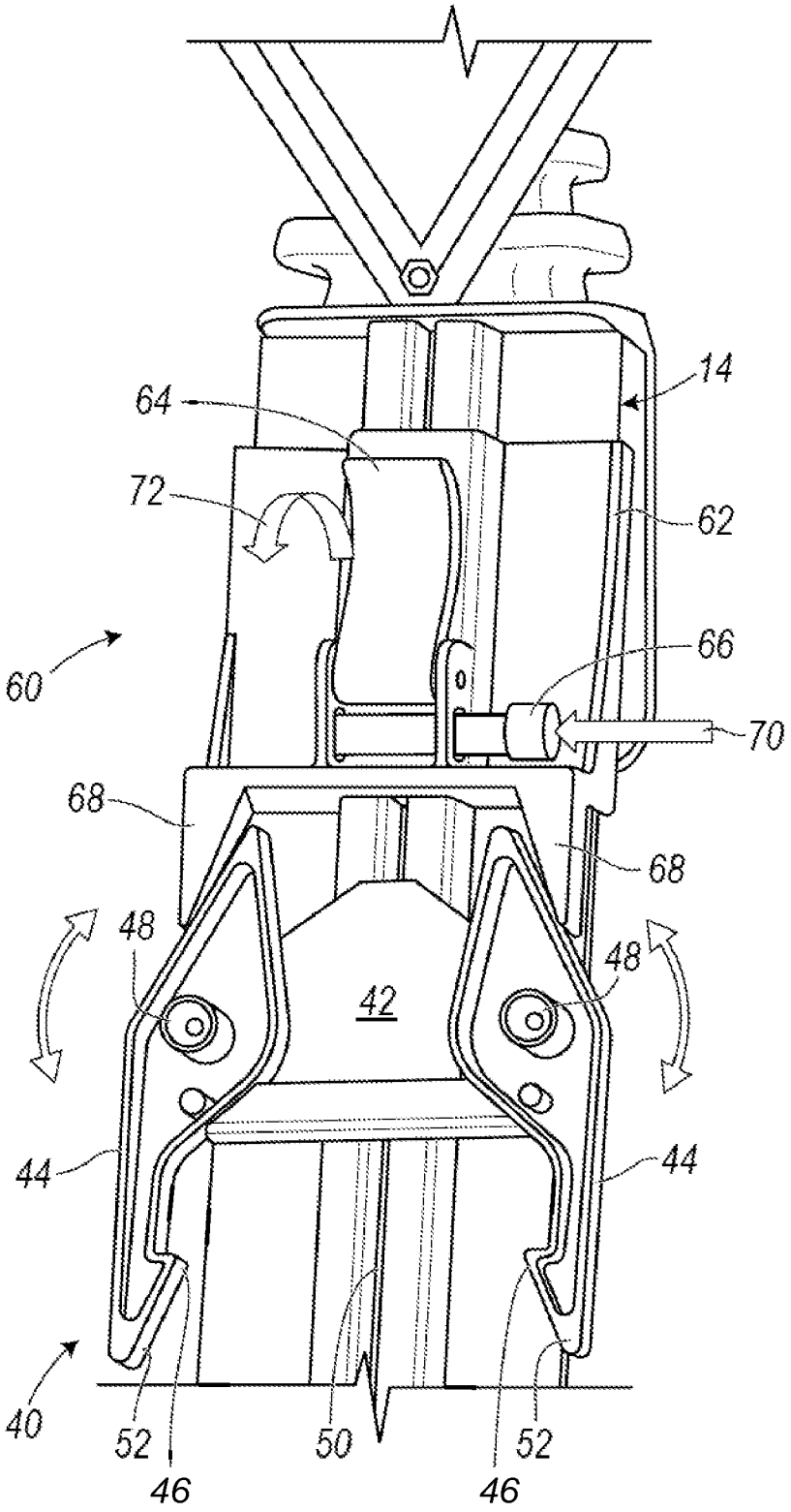
FIGS. 4 to 8 show views of the carrier and stop structure of the system of FIG. 1 in various configurations, and in various positions along the track.

The carrier 40 is movable between a lower position, which may also be referred to as a loading position, and an upper position, which may also be referred to as a launch position (FIG. 4). In the lower or loading position, the carrier 40 is positioned for the loading of the vehicle 12 therein. In the upper position or launch position, the carrier 40 engages the stop structure 60 so as to release the vehicle 12.

The carrier 40 includes a vehicle holder that is positioned for releasably holding the toy vehicle 12.

In embodiments, the vehicle holder may have any suitable structure positioned to releasably hold the toy vehicle 12. Referring to FIG. 4, in the embodiment shown, the vehicle holder of the carrier 40 includes a central member 42 with a pair of attached calipers 44. The central member 42 is attached to the track 14 by means of a protrusion on the underside of the central member 42 that inserts into an elongate gap 50 defined by the track 14. The calipers 44 include a first caliper arm **44*a* and an opposed second caliper arm 44*b*. Each caliper arm 44*a* and 44*b* defines a vehicle engagement surface 46. In this embodiment, each of the calipers 44 is pivotally attached to the central member 42. The pivotal attachment may be by a pin connection 48, thereby permitting the calipers 44 to pivot in the directions shown by the double-headed curved arrow lines. In other embodiments, only one of the calipers 44 may be pivotably attached central member 42, while the other one of the calipers 44 is fixedly attached to a central member 42. In still other embodiments, the individual caliper arms 44***a* and 44*b* of the calipers 44 may be pivotably attached directly to one another instead of individually being pivotally mounted to a central member.

Pivoting of the calipers 44 varies the distance between their respective vehicle engagement surfaces 46 such that the calipers 44 are movable between a vehicle holding position (FIGS. 5-8) in which the calipers 44 are positioned to hold the vehicle 12 by engagement with the vehicle engagement surfaces 46 with the caliper receiving surfaces 200 on the vehicle 12, and a vehicle release position (FIG. 9) in which the vehicle engagement surfaces 46 are disengaged from the caliper receiving surfaces 200 of the vehicle 12, so as to permit launching of the vehicle 12. The calipers 44 may be biased towards the vehicle holding position. More specifically, one or more caliper-biasing members 61 (e.g. such as one compression spring or one tension spring acting between the calipers 44, or a compression spring or a tension spring or a torsion spring for each caliper arm 44*a*, 44*b*, acting between the caliper arm 44*a*, 44*b* and an anchor point on the central member 42) may be positioned to urge the calipers 44 towards the vehicle-holding position. For example, the one or more caliper-biasing members 61 may include a first torsion spring in a first one of the calipers 44 and a second torsion spring in a second one of the calipers 44. As an example, a caliper-biasing member 61 is shown in the form of a first torsion spring in a first one of the calipers 44, in FIG. 7. It will be understood that a second torsion spring may be provided in the other of the calipers 44, even though not shown in the figure.

Figure 5:
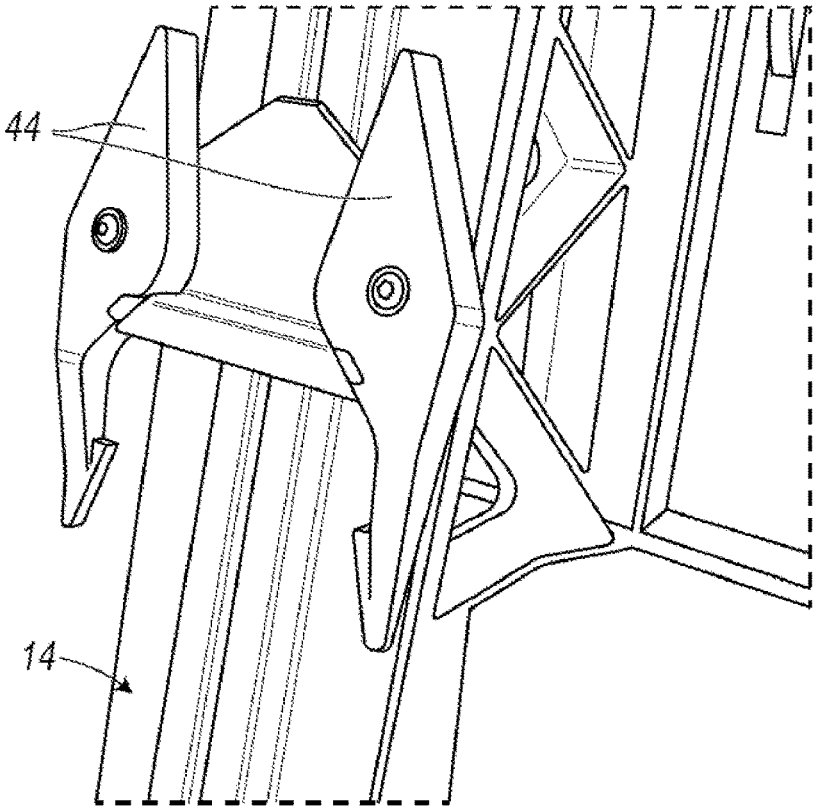

In use, when the carrier 40 is in the loading position as shown in FIG. 5, the vehicle 12 may be loaded on the carrier 40 in any suitable way, such as by translating the vehicle 12 along the track 14 such that the vehicle 12 engages the pusher surfaces on the ends 52 of the caliper arms 44*a* and 44*b*. This causes the caliper arms 44*a* and 44*b* to separate from each other. Once the vehicle 12 has been pushed into place the caliper biasing members 61 drive the caliper arms 44*a* and 44*b* to close such that the vehicle engagement surfaces 46 engage the caliper receiving surfaces 200 of the vehicle 12.

In the embodiment shown, the caliper receiving surfaces 200 are the walls of central wells, shown at 202 in the rear wheels, shown at 204, of the vehicle 12. Alternatively however, the caliper receiving surfaces 200 may be anywhere on the vehicle 12 such as in recesses on the vehicle body.

Figure 6:
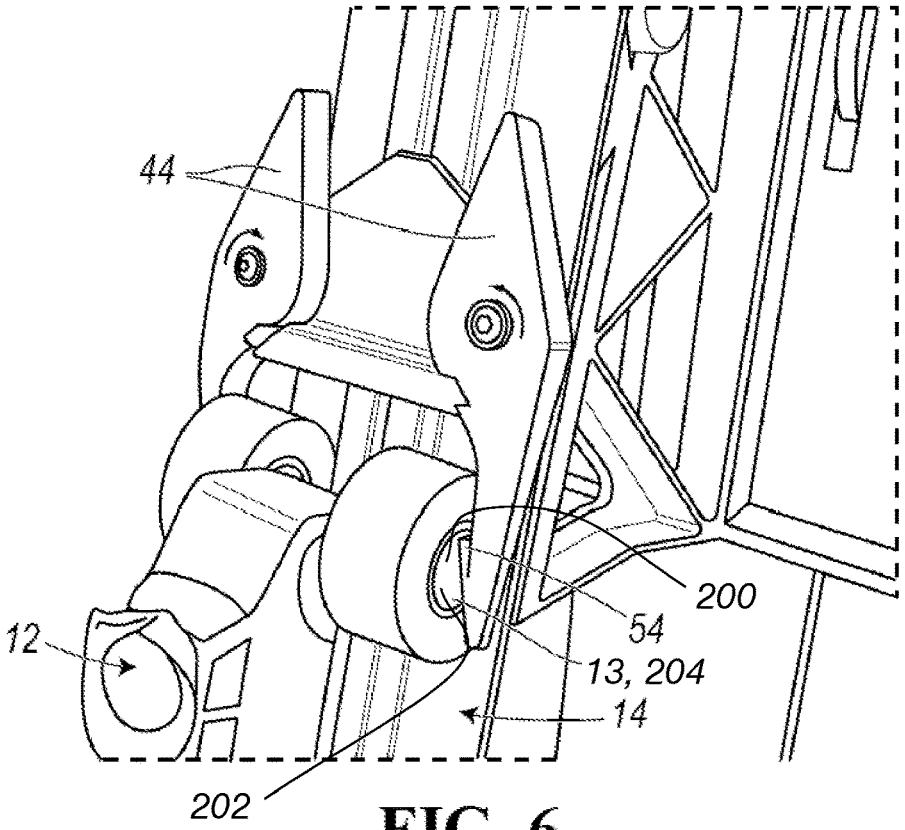
Figure 7:
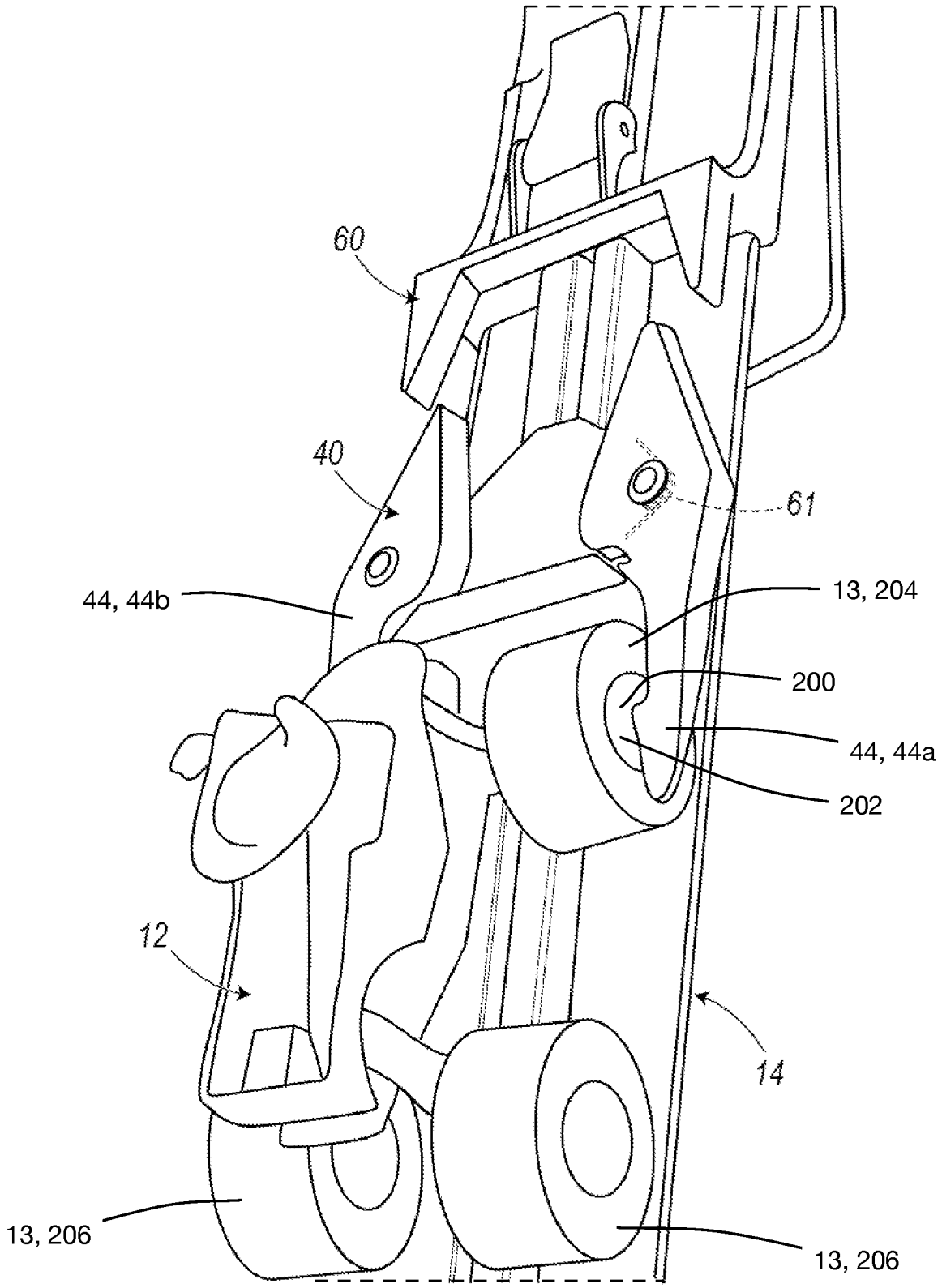
Figure 8:
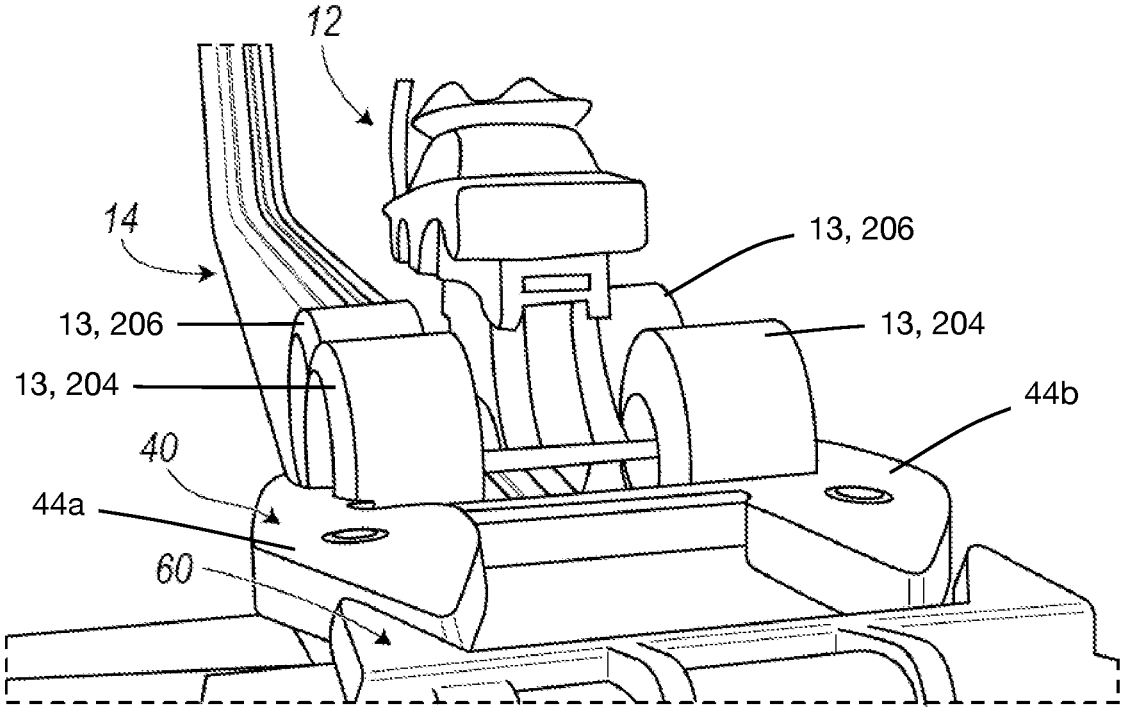

When the carrier 40 is in a vehicle-holding configuration as shown in FIGS. 6, 7 and 8, the opposed vehicle engagement surfaces 46 engage the tires of the vehicle 12. In this embodiment, the calipers 44 define shoulders 54 that are complementary in shape to the wheel of the vehicle 12. Engagement of the shoulders 54 with the wheel helps the calipers 44 to more securely hold the vehicle 12.

Alternatively, the calipers 44 may be biased towards the vehicle-holding configuration without the need for springs or the like, by their shape, such that gravity urges them towards the vehicle-holding configuration.

Stop Structure

A purpose of the stop structure 60 is to limit the travel of the carrier 40 on the track 14, and thus the "drop height" on the track 14 from which the vehicle 12 can be released. In embodiments, another purpose of the stop structure 60 is to actuate the carrier 40 from the vehicle-holding configuration to the vehicle-releasing configuration to release the vehicle 12 to roll down the track 14, as discussed above.

In embodiments, the stop structure may have different member(s) that are adapted to engage the vehicle holder of the carrier 40. Referring to FIG. 4, in the embodiment shown, the stop structure 60 includes a main stop structure body 62, a cam lever 64, a key member 66, and a pair of caliper-actuating members 68, as described below.

Figure 3:
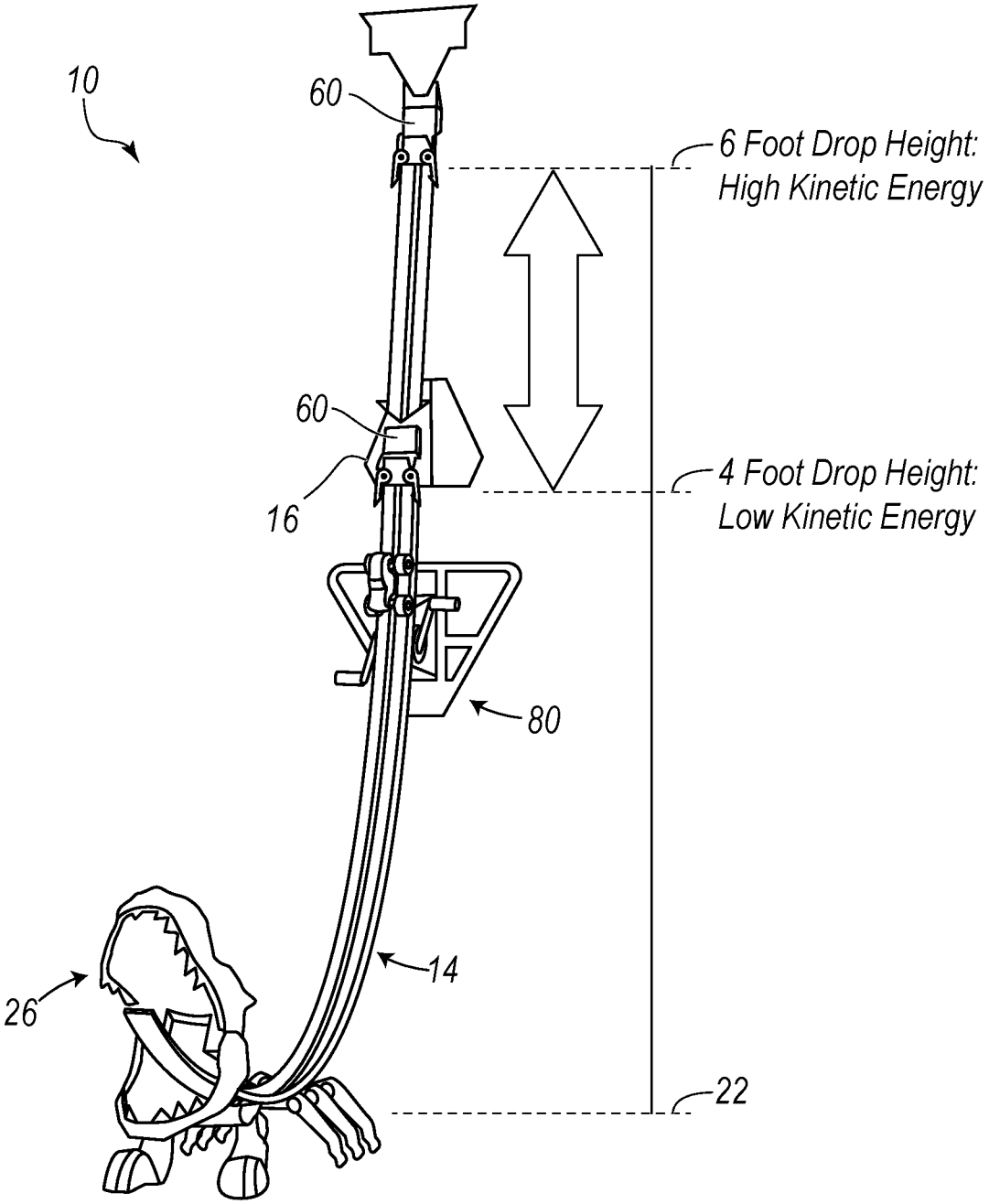
FIG. 3 is a front right perspective view of the system of FIG. 1 showing the stop member at a first drop height, or alternately at a higher second drop height along the track.

The main stop structure body 62 is attached to the track 14. The main stop structure body 62 is translatable along the toy track 14 to vary the position of the stop structure 60 along the toy track 14, but can be fixed in position using the cam lever 64 and key member 66. The cam lever 64 and the key member 66 are both associated with lock positions and unlock positions. In their lock positions as shown in FIG. 4, the cam lever 64 engages the underlying track 14 through an aperture defined by the main stop structure body 62. Friction between the cam lever 64 and the track 14 prevents translation of the main stop structure body 62 relative to the track 14. The key member 66 interferes with the cam lever 64 to prevent the cam lever 64 from pivoting from the lock position to the unlock position. In this manner, the key member 66 acts as a safety device. In order to adjust the position of the stop structure 60 along the track 14, the user moves the key member 66 to the unlock position by shifting the key member 66 leftward relative to the main stop structure body 62, as shown by the straight directional arrow 70 in FIG. 4. The key member 66 is shaped such that, in the unlock position, it permits pivoting moving of the cam lever 64. The user can then pivot the cam lever 64 downward relative to the main stop structure body 62 to the unlock position, as shown by the curved directional arrow 72 in FIG. 4. The cam lever 64 is shaped such that, in the unlock position, the cam lever 64 disengages from the track 14. The user can then slide the stop structure 60 along the track 14 to control the desired maximum "drop height" of the carrier 40, and then fix the position of the stop structure 60 by moving the cam lever 64 and the key member 66 to their lock positions. Referring to FIG. 3, for example, the stop structure 60 can be fixed in position on the track 14 to select a drop height of 4 feet (1.2 meters) or 6 feet (1.8 meters) above a horizontal surface 22 such as a floor.

Figure 9:
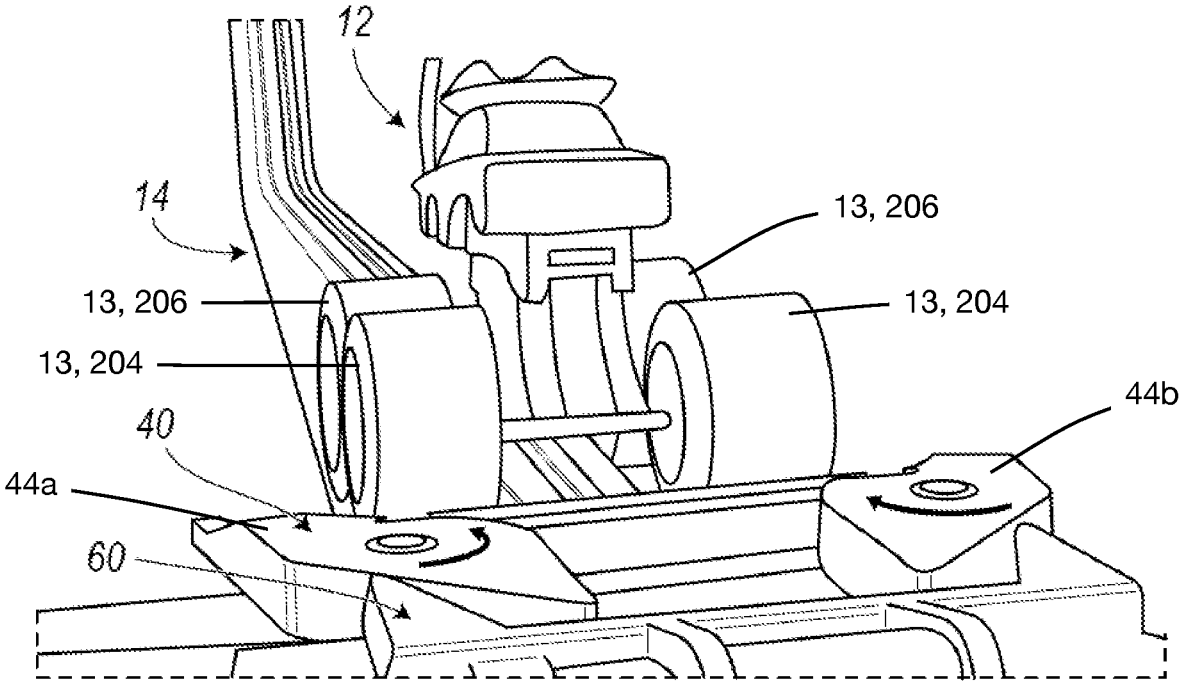
FIG. 9 is a top perspective view of the vehicle holder of the carrier in a vehicle-release configuration, while engaging the stop member, after releasing a toy vehicle.

Referring to FIG. 4, each of the caliper-actuating members 68 is associated with a different one of the pivotable calipers 44 of the carrier 40. In other embodiments of the carrier 40 having only one pivotable caliper 44, the stop structure 60 may have only one caliper-actuating member 68. In this embodiment, each of the caliper-actuating members 68 has an elongate triangular shape extending downward to a vertex. Referring to FIGS. 4, 7 and 8, the vertices of the caliper-actuating members 68 are positioned to engage sloped upper surfaces of the calipers 44 of the carrier 40. Referring to FIG. 9, the stop structure 60 is fixed in position along the track 14. As the carrier 40 moves up along the track 14 relative to the stop structure 60, the caliper-actuating members 68 urge the calipers 44 to pivot relative to the central member 42 of the carrier 40, in the direction shown by the curved arrows, into the vehicle-releasing configuration. This pivoting increases the distance between the opposed vehicle engagement surfaces 46, so that they disengage from the vehicle 12, and release the vehicle 12 to roll down the track 14.

Lifting Apparatus

A purpose of the lifting apparatus 80 is to lift the carrier 40 and the held vehicle 12 to the desired "drop height" on the track 14, and into engagement with the stop structure 60 so that the carrier 40 releases the vehicle 12 as described above. The lifting apparatus 80 may be used to lift the vehicle 12 beyond the reach of a user. Referring to FIG. 1, for example, the child 150 may use the lifting apparatus 80 within the child's reach to lift the carrier 40 and the held vehicle 12 to the upper end of the track 14 at about 6 feet (1.8 meters) above the horizontal surface 22.

Figure 10A:
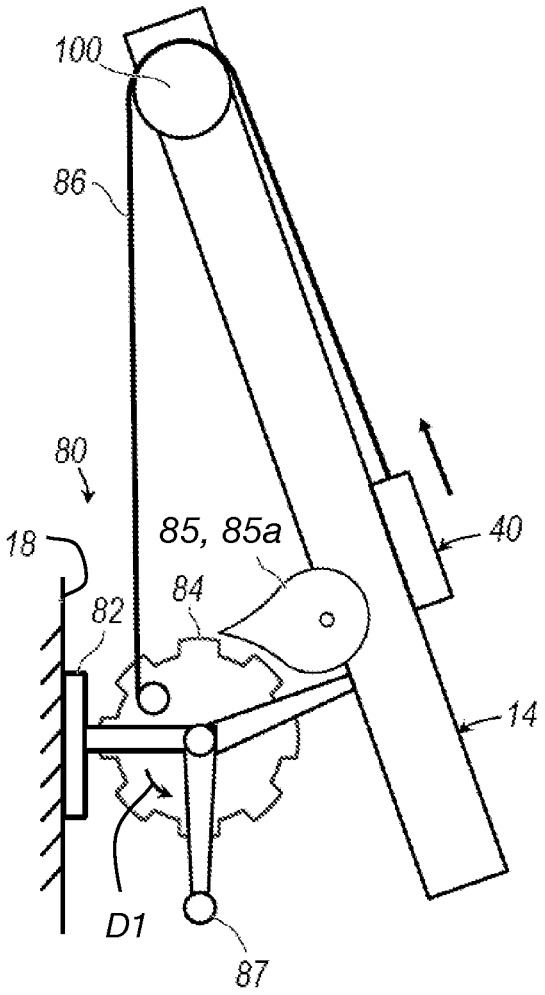
FIG. 10A is a schematic side view of a lifting apparatus of the system of FIG. 1, showing the one-way clutch in a release position.
Figure 11A:
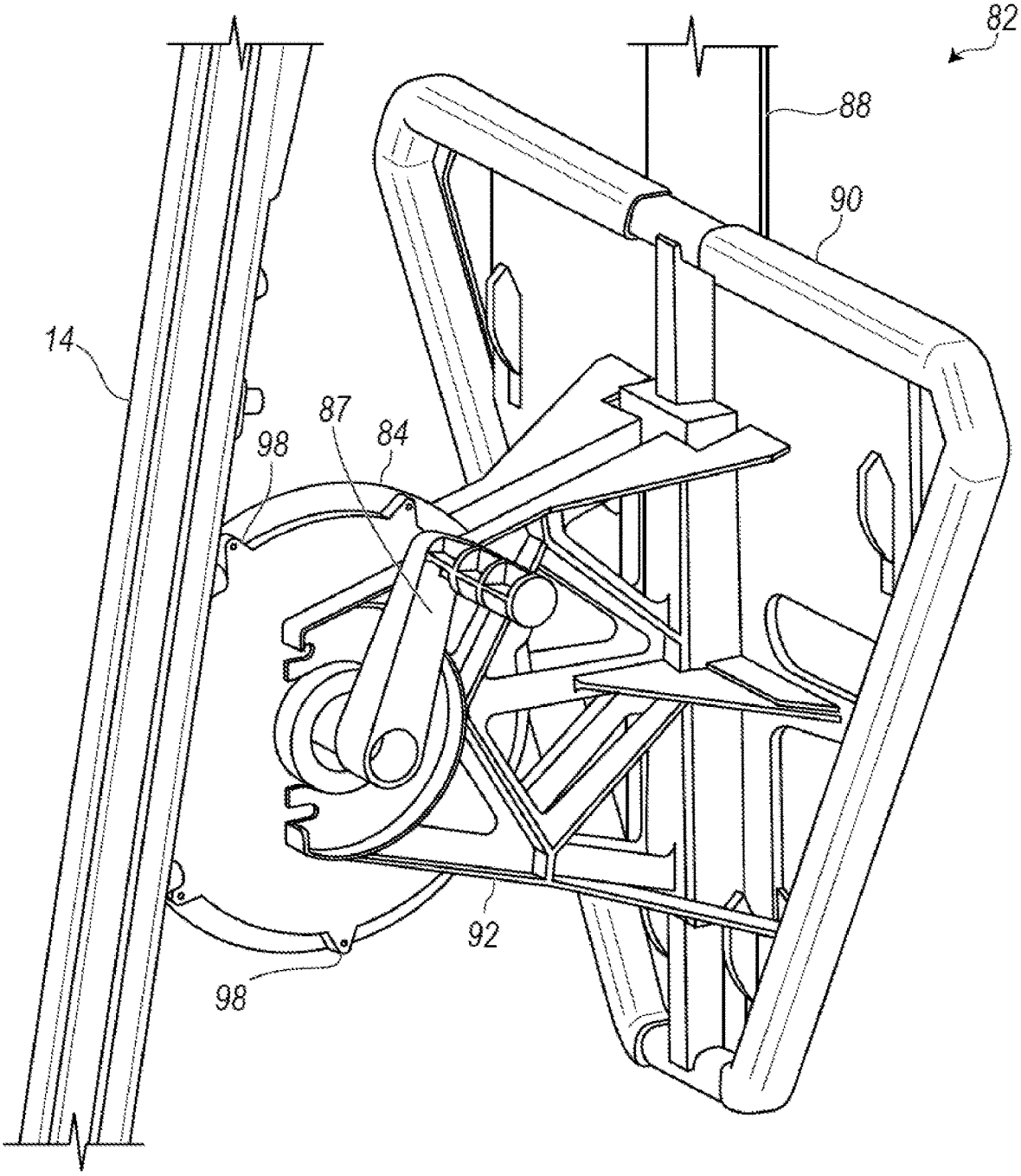
FIG. 11A is a right side perspective view of a lifting apparatus and part of the track of the system of FIG. 1.
Figure 11B:
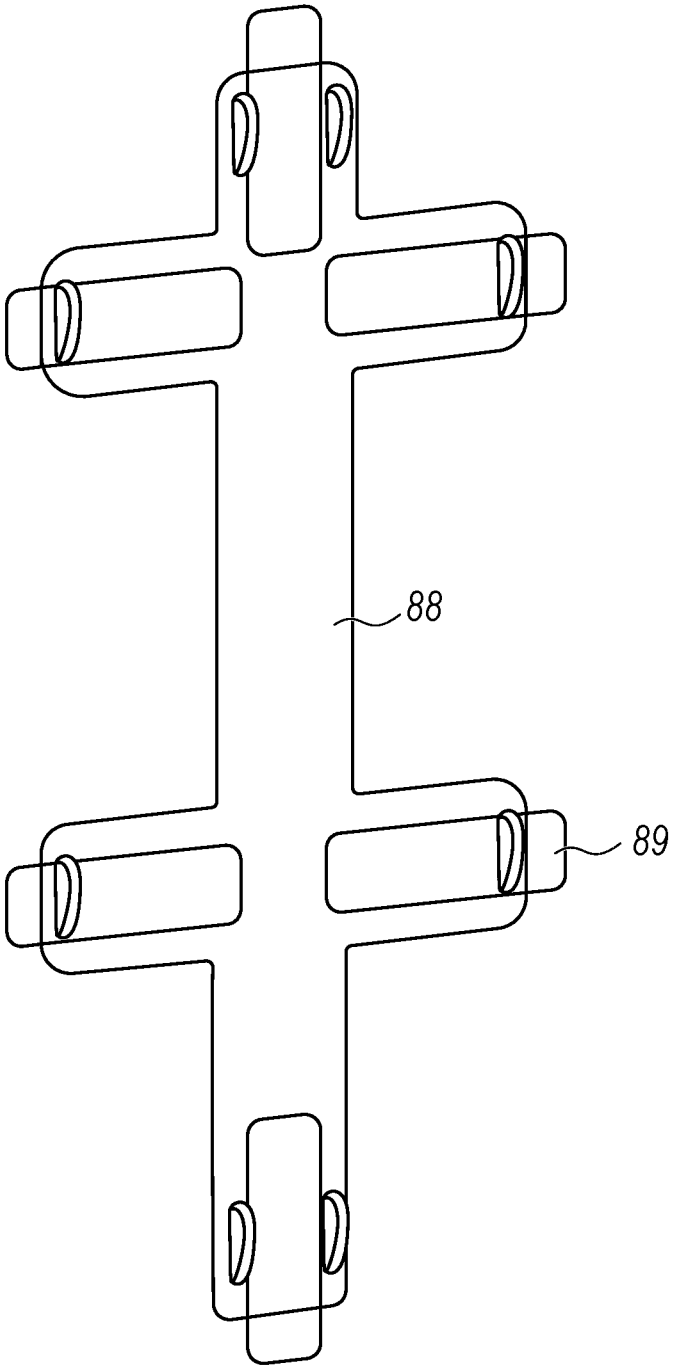
FIG. 11B is a left side perspective view of the bracket of a support member of a lifting apparatus of FIG. 11A.
Figure 12:
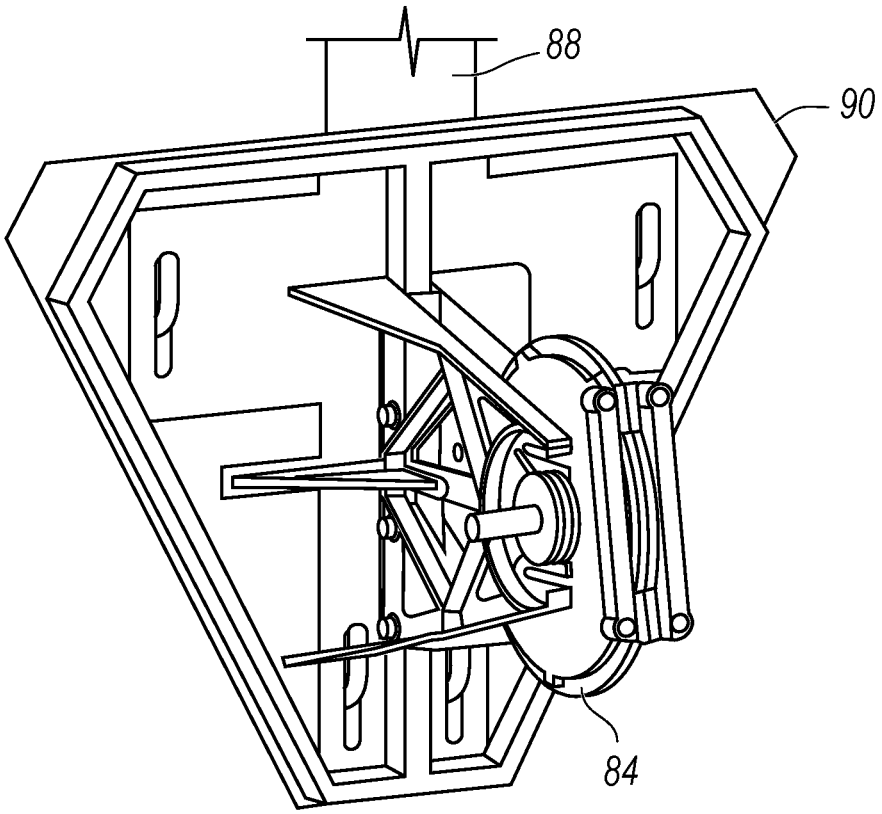
FIG. 12 is a left side perspective view of a lifting apparatus of the system of FIG. 1.
Figure 13:
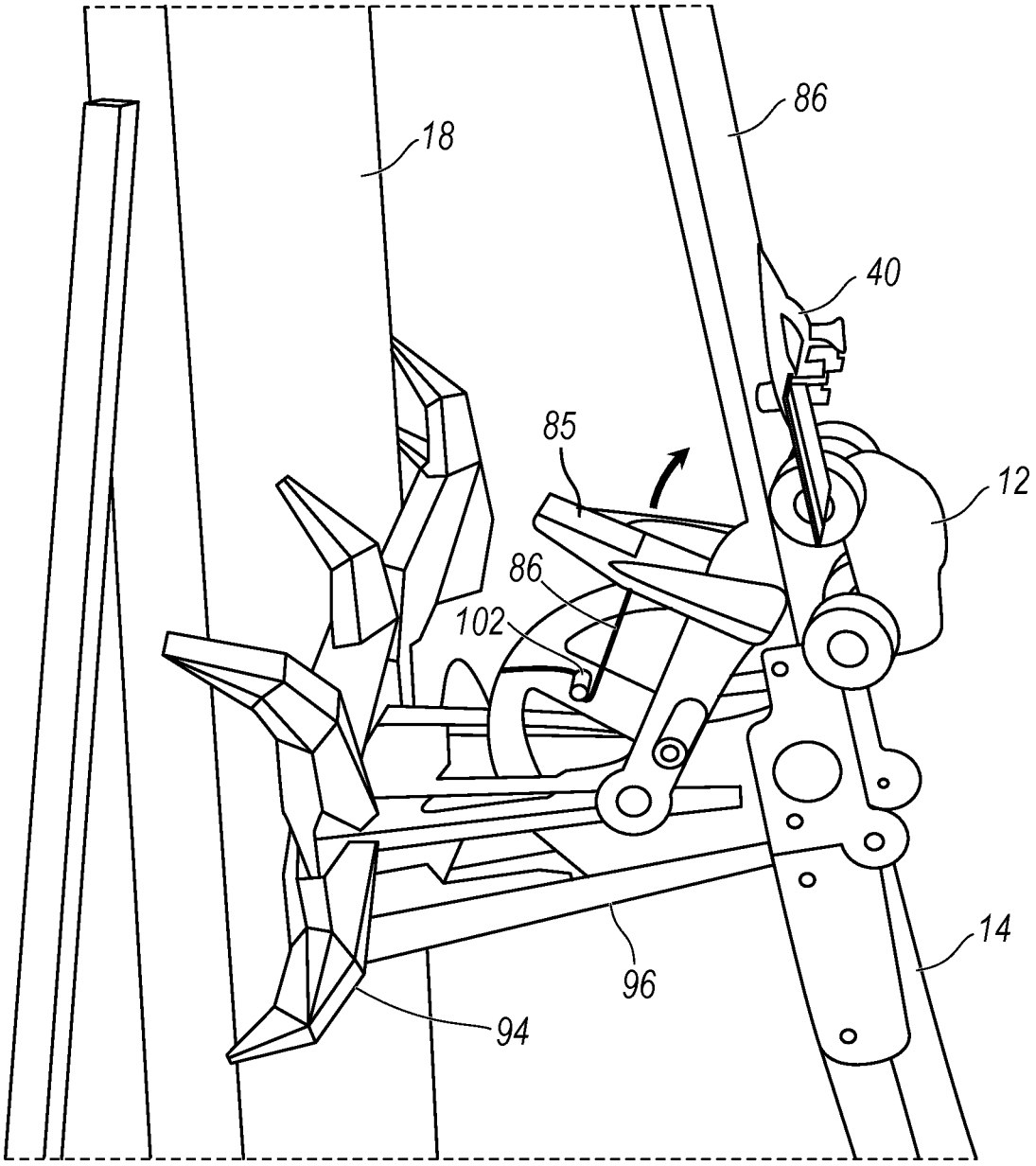
FIG. 13 is a left side perspective view of a lifting apparatus and track of another embodiment of a toy vehicle track system.

FIG. 10A shows a schematic representation of a lifting apparatus 80. In this embodiment, the lifting apparatus 80 includes a support member 82, a drive wheel 84, a one-way clutch 85, and a carrier line 86. These and other parts of the lifting apparatus 80 are described below. FIGS. 11 and 12 show one embodiment of the lifting apparatus 80, and FIG. 13 shows another embodiment of the lifting apparatus 80.

The support member 82 may be provided to rotatably support the drive wheel 84. In other embodiments, the support member 82 may be omitted, if for example, the drive wheel 84 is directly attached and rotatably attached to the track 14. In embodiments, the support member 82 is positioned to hold the track 14. In the embodiment shown, the support member 82 is also adapted to bear against a vertical surface 18 such as a wall. FIGS. 11A, 11B and 12 show one embodiment of a support member 82 including three parts. The first part is a bracket 88 that has a planar surface that interfaces with the vertical surface 18. As shown in FIG. 11B, the bracket may be attached to the vertical surface 18 using strips of stretch releasing adhesive tape 89, such as tape marketed under the name Command Strips™ (3M Company; USA). The second part is a substantially triangular-shaped frame 90 that releasably attaches to the bracket 88 by interference fit of tabs defined by the bracket 88 that insert into corresponding slots defined by the frame 90. The third part is a truss 92 that releasably attaches to the frame 90 by interference fit of tabs defined by the truss 92 that insert into corresponding slots defined by the frame 90. In this embodiments, the support member 82 is disposed above the horizontal surface 22 (e.g., floor) that supports the track and does not contact the horizonal surface 22.

In the embodiments shown, the drive wheel 84 is rotatably supported by the support member 82. The drive wheel 84 is rotatable to pull the carrier line 86, which in turn drives the carrier 40 towards the launch position. In the embodiment shown in FIGS. 10A, 10B, 11A, 12 and 13, the drive wheel 84 is disposed horizontally adjacent to the vertical surface 18 of the wall, and more particularly, horizontally between the vertical surface 18 of the wall and the track 14. This is advantageous in that the drive wheel 84 does not impede the user's view of the track 14, and conserves space. Referring to FIG. 10A, the drive wheel 84 is rotatable in a first drive wheel direction D1, about an axis that is transverse to the elongate direction of the track 14.

The one-way clutch 85 may have any suitable structure. In the embodiment shown, the one-way clutch includes a plurality of teeth 98, which may optionally be near a periphery of the drive wheel 84. In the embodiment shown in FIGS. 10A and 10B, the teeth 98 extend across the entire thickness of the drive wheel 84. In the embodiment shown in FIGS. 11A and 12 the teeth 98 do not extend across the entire thickness of the drive wheel 84, but are instead flanked by a flange on one side thereof. A handle 87 is attached to the drive wheel 84 for manually rotating the drive wheel 84.

Figure 10B:
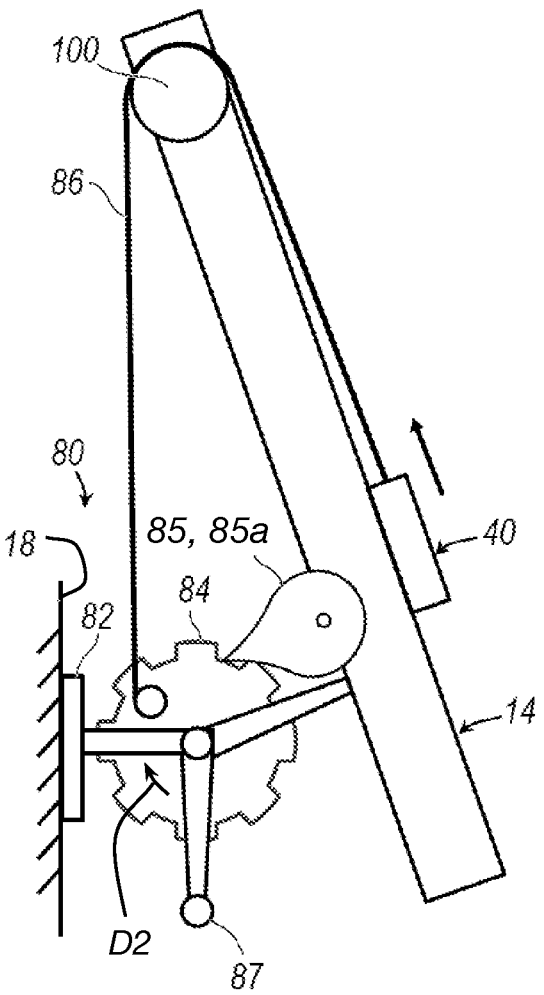
FIG. 10B is a schematic side view of a lifting apparatus of the system of FIG. 1, showing the one-way clutch in a holding position.

The one way clutch 85 further includes a pawl 85*a* that engages the plurality of teeth 98 on the drive wheel 84. Worded more broadly, a plurality of teeth 98 are driven to rotate due to rotation of the drive wheel 84. The pawl 85*a* is positioned to engage the plurality of teeth 98 to prevent rotation of the drive wheel 84 in a second rotational direction D2 that is opposite the first rotational direction. In the embodiment shown, the pawl 85*a* is positioned to be pushed away by the teeth 85*b* during rotation of the drive wheel 84 in the first rotational direction D1 (i.e. a counter-clockwise direction in the view shown in FIGS. 10A and 10B), which is the direction in which to drive the carrier 40 towards the launch position. Thus, the pawl 85*a* permits rotation of the drive wheel 84 in the first rotational direction D1. The pawl 85*b* is positioned to engage the teeth 85*b* thereby blocking rotation of the drive wheel 84, during rotation of the drive wheel 84 in the second rotational direction D2 (i.e. clockwise in the view shown in FIGS. 10A and 10B) so as to permit the user, while cranking the handle 87 to drive the carrier 40 towards the launch position, to let go of the handle 87 momentarily, without the carrier 40 falling all the way down to its bottom-most position. Then the user can regrip the handle 87 to continue rotating the drive wheel 84 in the first rotational direction D1 so as to continue driving the carrier 40 towards the launch position. When the pawl 85*a* is engaged with the teeth 98 to prevent rotation of the drive wheel 84 in the second rotational direction D2 (i.e. when the drive wheel 84 is attempted to be rotated in the second rotational direction D2), the pawl 85*a* may be said to be in a holding position (FIG. 10B). When the drive wheel 84 is rotated in the first rotational direction D1 and therefore the pawl 85*a* is positioned such that the pawl 85*a* permits the rotation of the drive wheel 84 in the first rotational direction D1, the pawl 85*a* may be said to be in a release position (FIG. 10A). Based on the above, the one-way clutch 85 may be said to permit rotation of the drive wheel 84 in the first rotational direction D1, and to prevent rotation of the drive wheel 84 in the second rotational direction D2.

While the one-way clutch operated by interference of the pawl 85*a* with the drive wheel 84, in other embodiments, the pawl 85*a* may instead resist movement of the drive wheel 84 by frictional engagement with the drive wheel 84 or with the carrier line 86. For example, the pawl 85*a* may be shaped in the form of a cam that is rotated into progressive tighter engagement with the drive wheel 84 or with the carrier line 86 by rotation of the drive wheel 84 in the second rotational direction D2, so as to stop further rotation of the drive wheel of the drive wheel 84 in the second rotational direction D2.

FIG. 13 shows another embodiment of a support member 82 that includes parts in the shape of a pair of stylized dinosaur feet 94 that bear against the vertical surface 18, and legs 96 that extend horizontally toward the track 14. In this embodiment, the legs 96 are attached to the track 14, and therefore the support member 82 at least partially supports the track 14. In still other embodiments, the support member 82 may have different forms.

Figure 14:
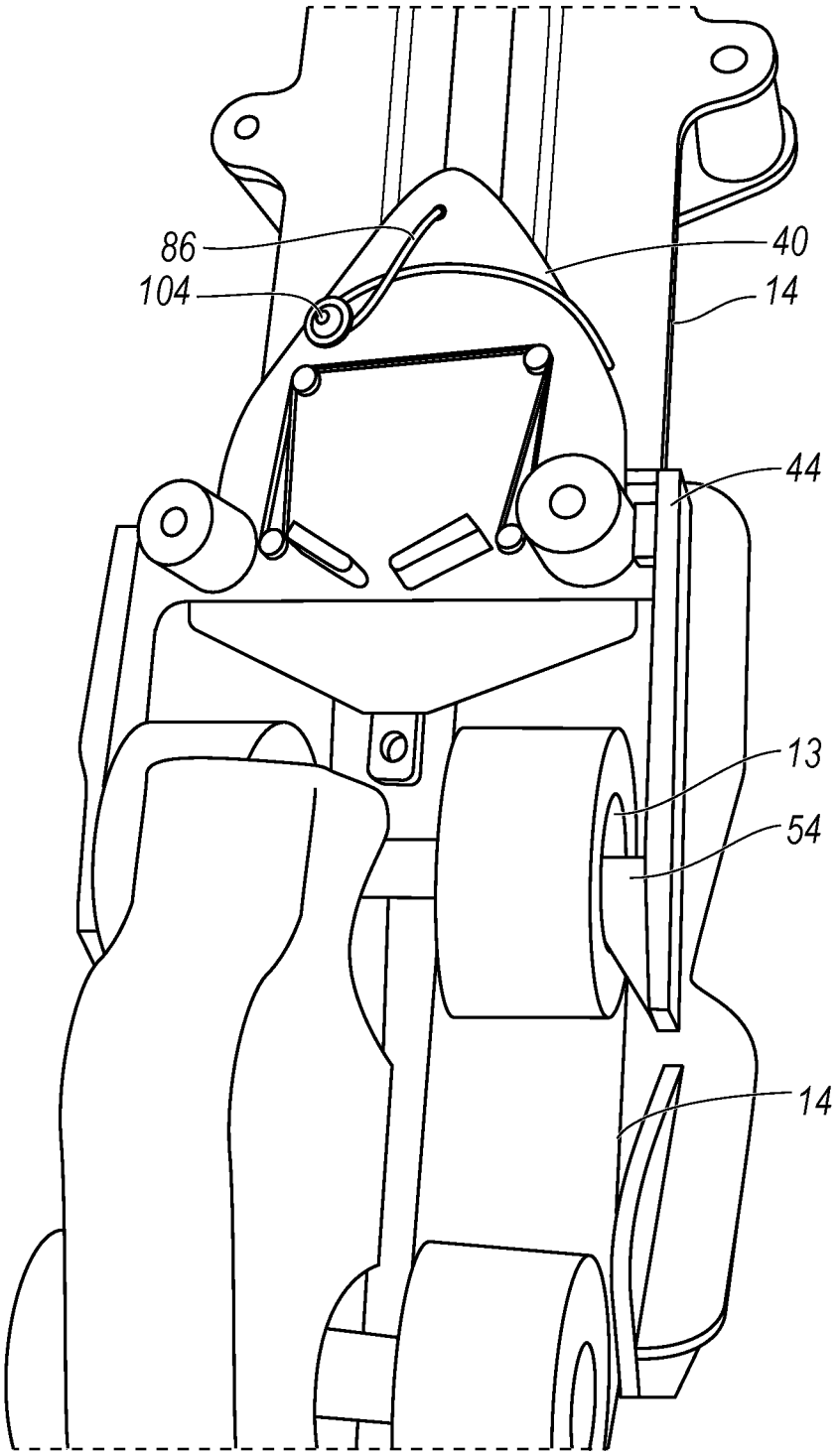
FIG. 14 is a front perspective view of the carrier of the system of FIG. 13.

The carrier line 86 may be a flexible member, with non-limiting examples being a cord, a string, a ribbon, a chain, a cable, or the like. The carrier line 86 is engaged with the drive wheel 84 and attached to the carrier 40. Referring to FIG. 10, the carrier line 86 may be routed around a sheave 100 or similar structured attached to the track 14 near its upper end. Such a sheave 100 may not necessary if the drive wheel 84 is disposed above the desired drop height of the vehicle 12. Referring to the embodiment shown in FIG. 13, the carrier line 86 is engaged with the drive wheel 84 by being tied to a stud 102 that is attached to the drive wheel 84. Referring to the embodiment shown in FIG. 14, for example, the carrier line 86 is engaged with the carrier 40 by being tied to a stud 104 that is attached to the carrier 40, and received in the gap 50 defined by the track 14. In other embodiments, the carrier line 86 may be engaged with the drive wheel 84 and the carrier 40 in different ways. For example, the drive wheel 84 may be attached to a winch drum connected to a drive wheel 84, and the carrier line 86 may be wound around the winch drum. In either case, when the drive wheel 84 is rotated relative to the support member 82 in the first wheel direction, the drive wheel 84 pulls the carrier line 86 to move in the first carrier line direction, which turns pulls the carrier 40 and the held vehicle 12 up the track 14.

Stunt Apparatus

Figure 20:
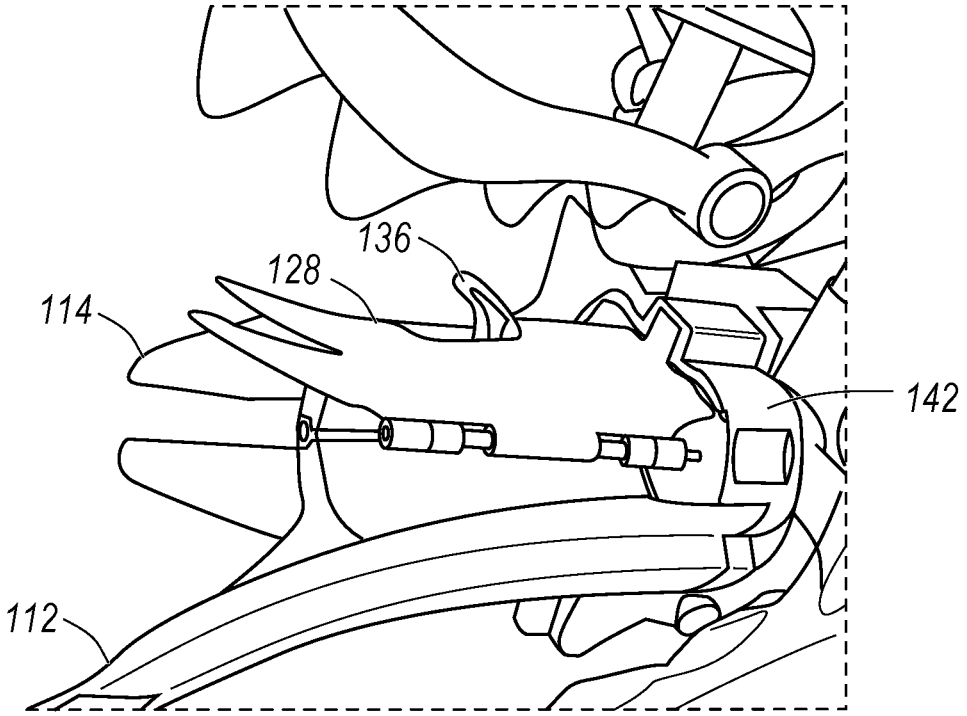
Figure 21:
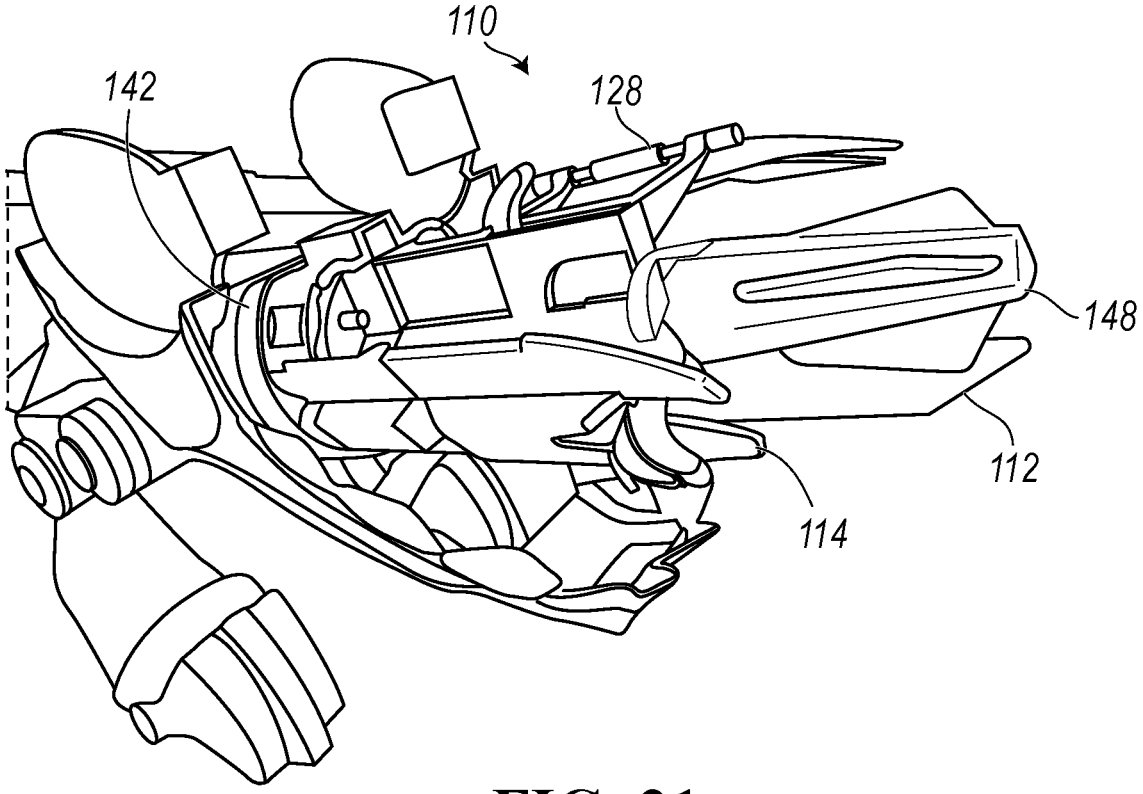
FIG. 21 shows the stunt apparatus with a knob.
Figure 22:
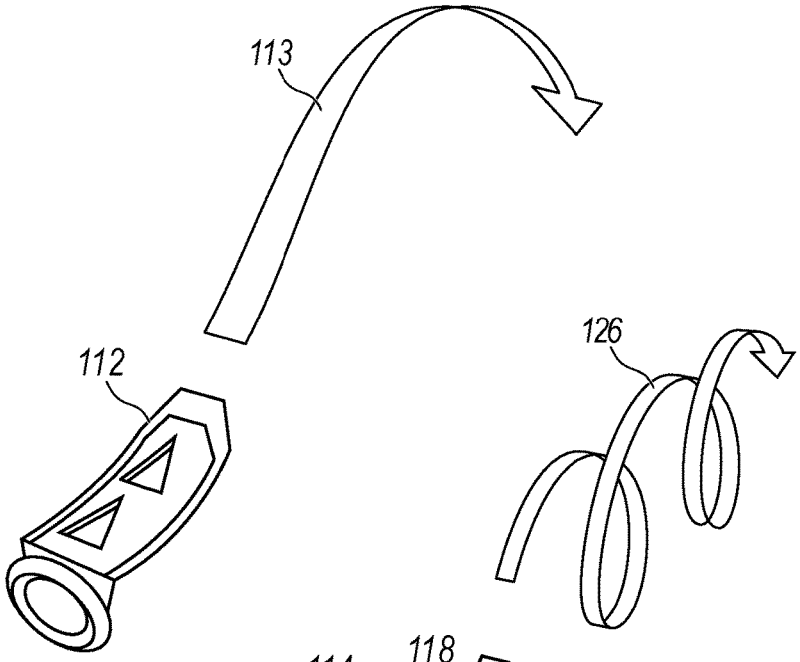
FIGS. 22 to 24 show rear right side perspective views of different stunt track segments and motions of a toy vehicle induced by them.
Figure 23:
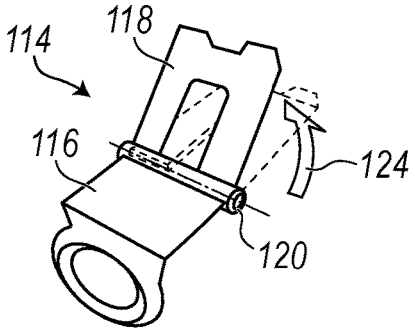
Figure 24:
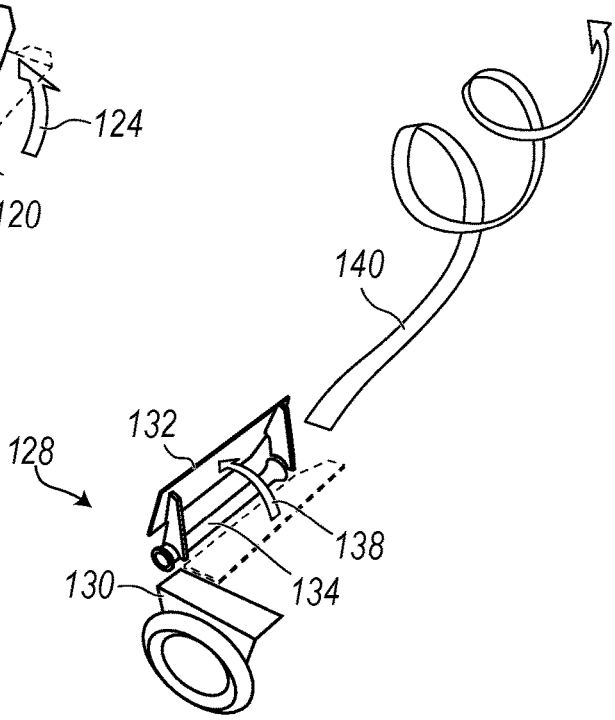

A purpose of the stunt apparatus 110 is to allow a plurality of different stunt track segments to be selectively and individually aligned with the track 14. FIGS. 15 to 21 show one embodiment of a stunt apparatus 110. FIGS. 22 to 24 show different stunt track segments. The stunt apparatus 110 includes a plurality of stunt track segments attached to a rotary indexer 142, as described below.

Figure 18:
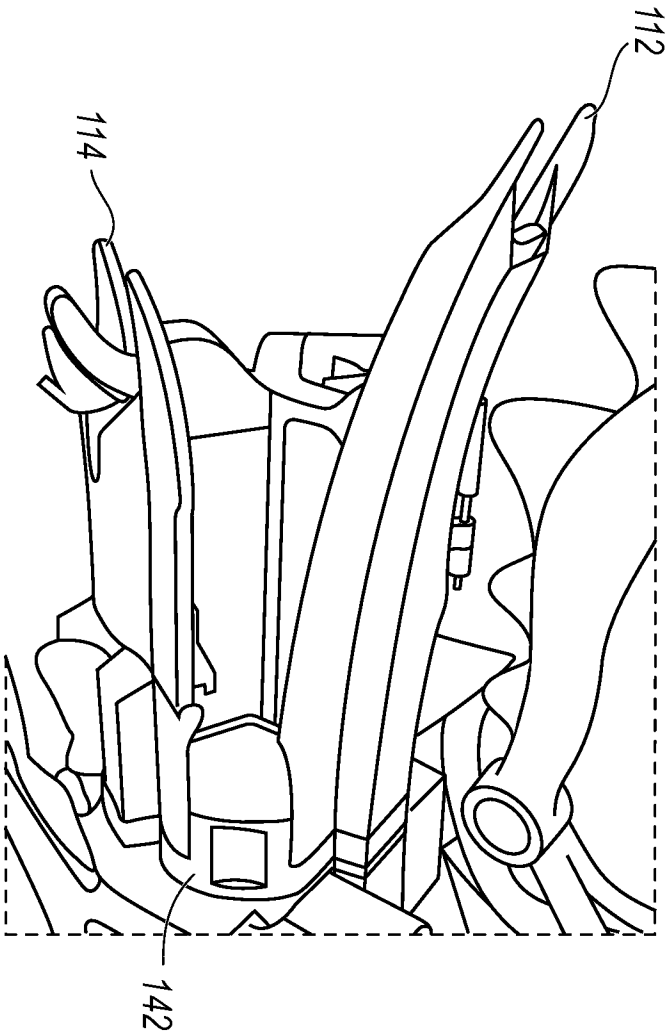
Figure 19:
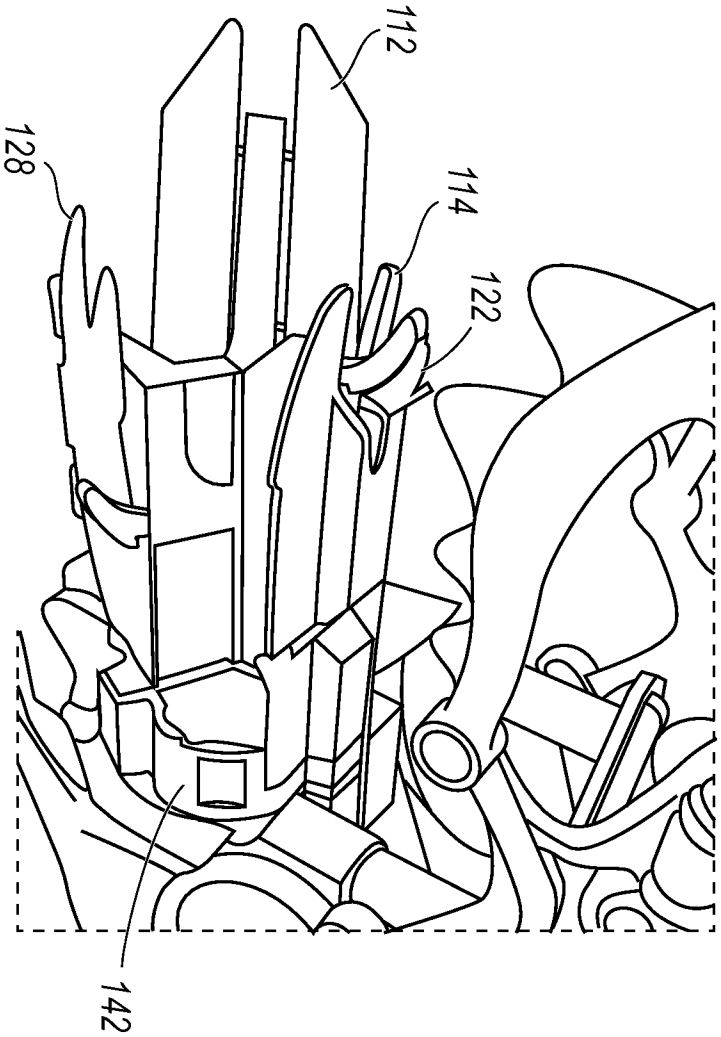

As used herein, a "stunt track segment" refers to a segment of toy track that is adapted to induce a motion of the vehicle 12 when the vehicle 12 travels over the stunt track segment. The plurality of stunt track segments may be any integer number of stunt track segments greater or equal to two stunt track segments. In the embodiments shown in the Figures, the stunt apparatus 110 includes three stunt track segments. As shown in FIGS. 18 and 22, a first stunt track segment 112 has an upwardly curved ramp surface for inducing a "high arc" jumping motion to the vehicle 12 as shown by the curved arrow line 113. As shown in FIGS. 19 and 23, a second stunt track segment 114 has a first portion 116 and a second portion 118 pivotably connected thereto by a pin 120. As the vehicle 12 passes over a trigger mechanism 122 (FIG. 19) of the second stunt track segment 114, a biasing spring (not shown) such as a torsion spring, is released and actuates the second portion 118 to pivot upwardly about an axis transverse to the travel direction along the track 14 as shown by the curved arrow line 124 (FIG. 23) and thereby "kick" the vehicle 12 into a forward somersault motion as shown by the curved arrow line 126 (FIG. 23). As shown in FIGS. 20 and 24, a third stunt track segment 128 has a first portion 130 and a second portion 132 pivotably connected thereto by a pin 134. As the vehicle 12 passes over a trigger mechanism 136 (FIG. 20) of the third stunt track segment 128, a biasing spring (not shown) such as a torsion spring, is released and actuates the second portion 132 to pivot upwardly about an axis transverse to the travel direction along the track 14 as shown by the curved arrow line 138 (FIG. 24) and thereby "kick" the vehicle 12 into a barrel roll motion as shown by the curved arrow line 140 (FIG. 24). In other embodiments, the stunt apparatus 110 may include additional or alternative stunt track segments for inducing different types of motions.

Figure 25:
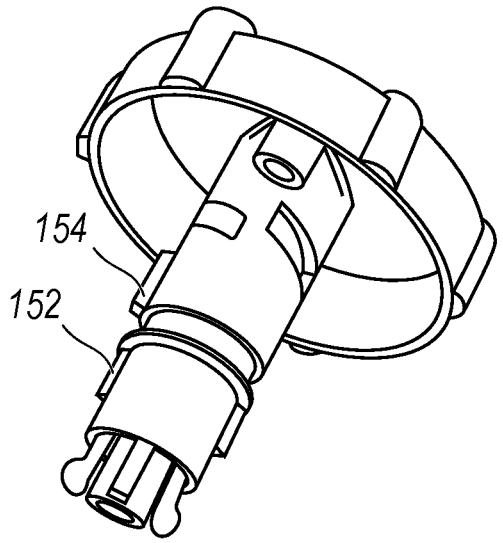
FIGS. 25 to 26 show perspectives view of a rotary indexer of the stunt apparatus of FIG. 15.
Figure 26:
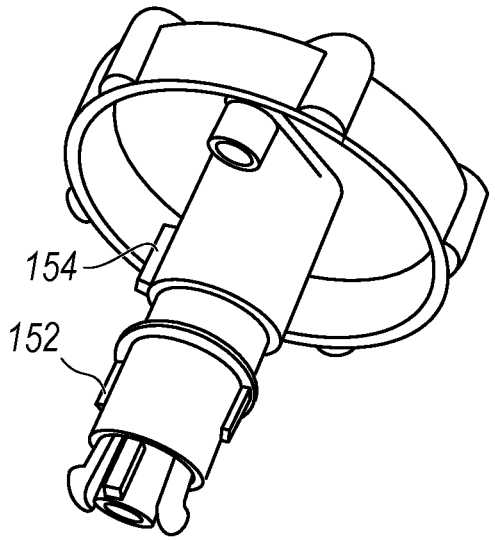

As used herein, "rotary indexer" refers to a device having a first part and a second part attached to the first part and rotatable relative to the first part to a plurality of pre-defined positions. As an example, FIGS. 25 and 26 show an embodiment of a rotary indexer 152 having a substantially cylindrical first part 152 that inserts into substantially tubular second part 154. The second part 154 defines slots (FIG. 25) that receive tabs angularly distributed on the surface of the first part 152 to fix rotation of the second part in a plurality of pre-defined orientations relative to the first part 152, including a first orientation shown in FIG. 25, and a second orientation shown in FIG. 26.

Figure 15:
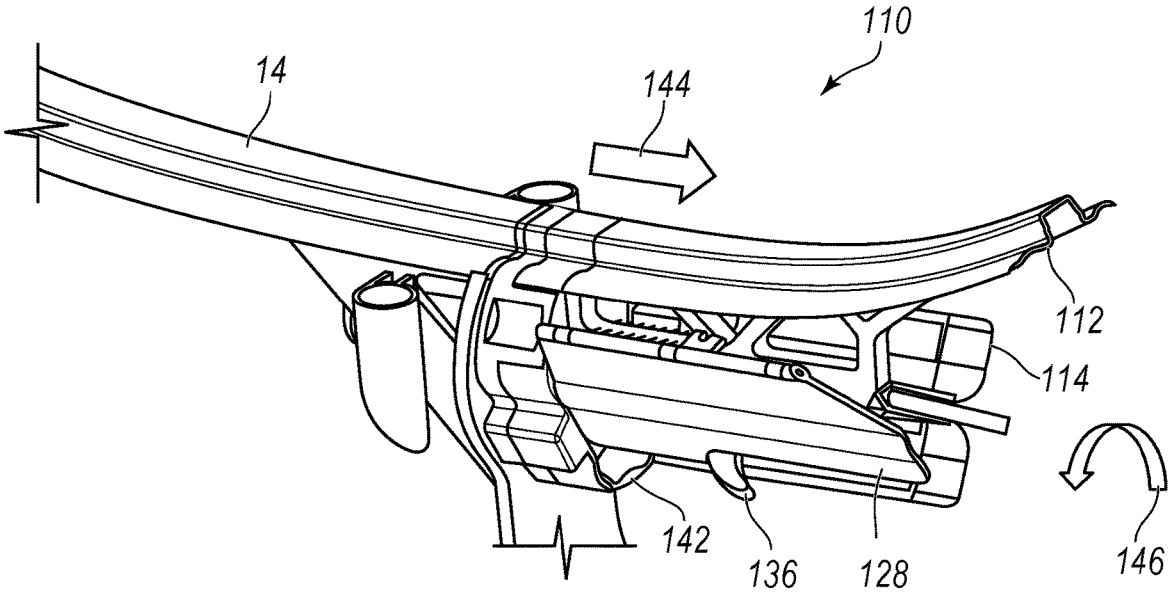
FIGS. 15 to 20 show views of the stunt apparatus of the toy of FIG. 1.
Figure 16:
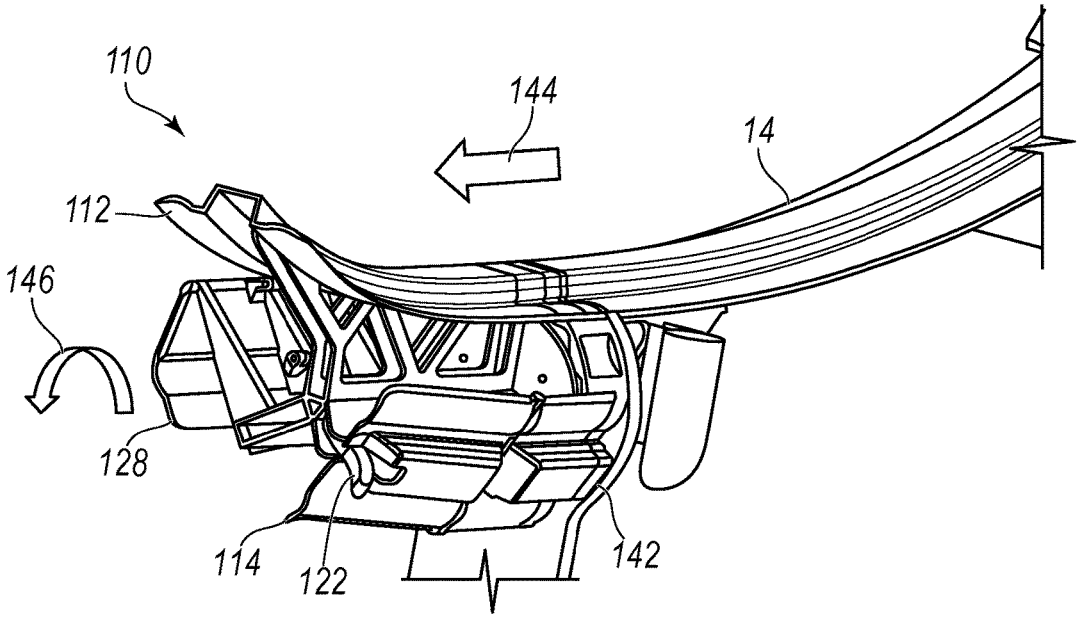
Figure 17:
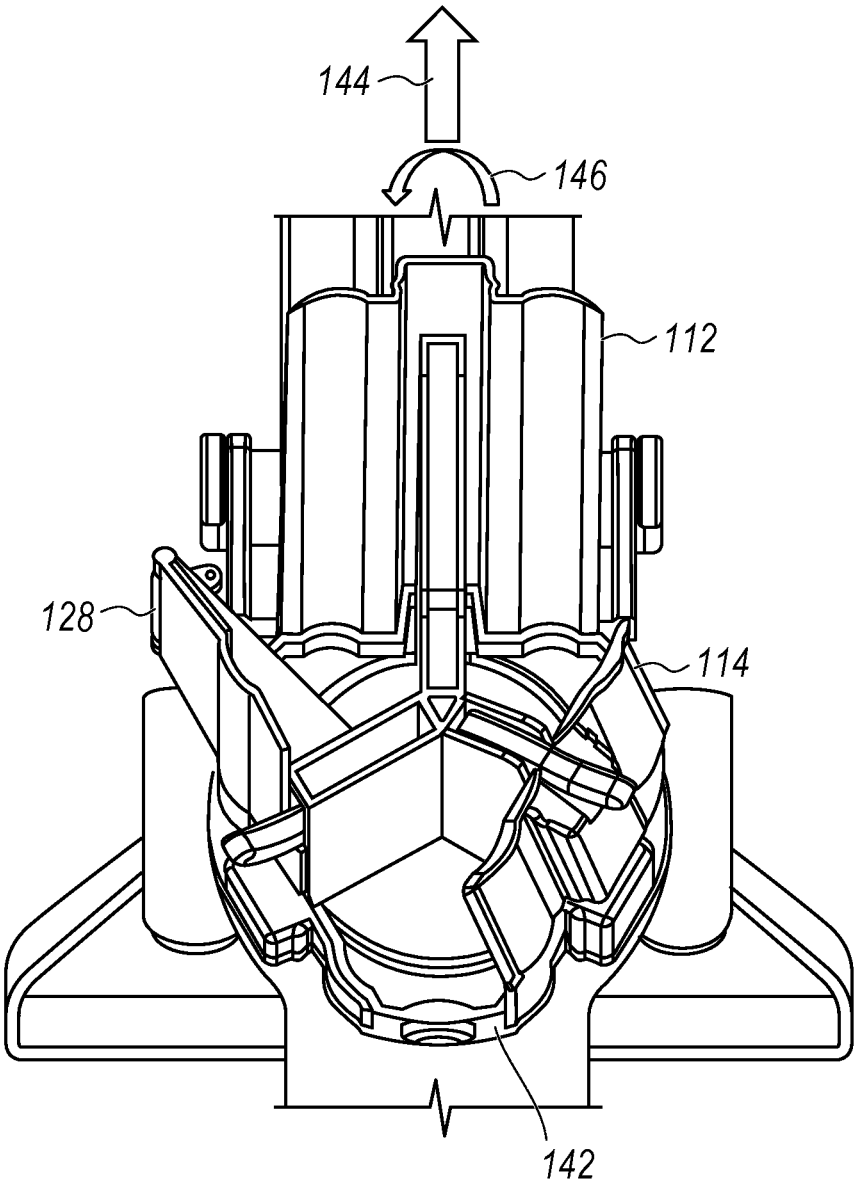

Referring to FIGS. 15 to 17, the plurality of stunt track segments are attached to the rotary indexer 142. The track 14 defines a travel direction for the toy vehicle 12 as shown by the directional arrow 144. The rotary indexer 142 permits the stunt track segments to be rotated, as shown by the curved directional arrow 146, about an axis that is substantially parallel to the travel direction, to selectively align each one of the stunt track segments individually with the track 14. That is, the track 14 and the aligned stunt track segment form a continuous travel path for the vehicle 12, even though there may be a small gap 50 between them. FIGS. 18, 19, and 20 show the rotary indexer 142 in first, second and third orientations, respectively, in which the first, second and third stunt track segments 112, 114, 128, respectively, are aligned with the track 14. FIG. 21 shows a knob 148 attached to the rotary indexer 142 to facilitate rotating the stunt track segments.

By virtue of the stunt track segments being rotatable about an axis that is substantially parallel to the travel direction defined by the track 14, the stunt apparatus 110 as a whole has a relatively compact configuration. This allows the stunt apparatus 110 to be placed within the confines of a part such as the stylized dinosaur head 26 with the stunt track 14 elements projecting outwardly in a tongue-like fashion, as shown in FIG. 1.

PARTS LIST

10 system
12 toy vehicle
13 toy vehicle, wheel
14 toy track
15 toy track, segment
16 toy track, upper support member
18 vertical surface (e.g., door or wall)
20 toy track, first lower support member
22 horizontal surface (e.g., floor)
24 toy track, second lower support member
26 stylized dinosaur head
28 landing ramp
30 smart phone holder
40 carrier
42 central member
44 caliper
46 vehicle engagement surface
48 pin connection
50 gap
52 end
54 shoulder
60 stop structure
61 caliper biasing member
62 stop structure, main stop structure body
64 cam lever
66 key member
68 caliper-actuating member
70 directional arrow showing sliding of key member
72 directional arrow showing pivoting of cam lever
80 lifting apparatus
82 lifting apparatus, support member
84 lifting apparatus, drive wheel
85 lifting apparatus, one-way clutch
86 lifting apparatus, carrier line
87 lifting apparatus, handle
88 lifting apparatus, support member, first part (bracket)
89 stretch releasing adhesive tape
90 lifting apparatus, support member, second part (frame)
92 lifting apparatus, support member, third part (truss)
94 lifting apparatus, support member, feet
96 lifting apparatus, support member, legs
98 lifting apparatus, support member, drive wheel, teeth
100 lifting apparatus, sheave
102 lifting apparatus, drive wheel, stud

104 carrier, stud
110 stunt apparatus
112 stunt apparatus, first stunt track segment
113 directional arrow, motion of vehicle
114 stunt apparatus, second stunt track segment
116 stunt apparatus, second stunt track segment, first portion
118 stunt apparatus, second stunt track segment, second portion
120 stunt apparatus, second stunt track segment, pin
122 stunt apparatus, second stunt track segment, trigger mechanism
124 directional arrow, motion of second stunt track segment, second portion
126 directional arrow, motion of vehicle
128 stunt apparatus, third stunt track segment
130 stunt apparatus, third stunt track segment, first portion
132 stunt apparatus, third stunt track segment second portion
134 stunt apparatus, third stunt track segment, pin
136 stunt apparatus, third stunt track segment, trigger mechanism
138 directional arrow, motion of third stunt track segment, second portion
140 directional arrow, motion of vehicle
142 stunt apparatus, rotary indexer
144 directional arrow, travel direction defined by track
146 directional arrow, rotation of rotary indexer
148 knob
150 child
152 stunt apparatus, rotary indexer, first part
154 stunt apparatus, rotary indexer, second part
200 caliper receiving surface
202 well
204 rear wheel
206 front wheel

What is claimed is:

1. A lifting apparatus for lifting a toy vehicle along a segment of a toy track, the segment having an upper end, the lifting apparatus comprising:

a carrier including a vehicle holder that is positioned for holding the toy vehicle, wherein the carrier is movable towards the upper end of the segment and is releasably connectable to the toy vehicle;

a drive wheel rotatable relative to the segment;

a carrier line that is attached to the carrier and which is engageable with the drive wheel such that rotation of the drive wheel in a first drive wheel direction drives the carrier line to travel in a first carrier line direction so as to lift the carrier and the toy vehicle towards the upper end of the segment; and a one-way clutch that is positionable in a release position to permit the carrier line to move in the first carrier line direction so as to permit lifting of the carrier, and is positionable in a holding position to resist movement of the carrier line in a second carrier line direction that is opposite to the first carrier line direction so as to hold the carrier against dropping.

2. The lifting apparatus of claim 1, wherein the lifting apparatus further comprises a support member that supports either the drive wheel or the toy track, or both, wherein the support member bears against a vertical surface, and, wherein at least part of the drive wheel is disposed horizontally between the segment of the toy track and the vertical surface.

3. The lifting apparatus of claim 1, wherein the lifting apparatus further comprises a support member that rotatably supports the drive wheel, wherein the toy track is supported on a horizontal surface, and wherein the support member does not contact the horizontal surface.

4. The lifting apparatus of claim 1, wherein the lifting apparatus further comprises a support member that rotatably supports the drive wheel, and wherein the support member at least partially supports the toy track.

5. The lifting apparatus of claim 1, wherein the lifting apparatus further comprises a support member that rotatably supports the drive wheel, and wherein the support member is removably attached to a vertical surface adjacent to the segment of the toy track.

6. The lifting apparatus of claim 5, wherein the support member comprises a first part comprising a planar surface that is removably attached to the vertical surface, and a second part extending horizontally from the first part and releasably attached by interference fit to the first part.

7. The lifting apparatus of claim 5, wherein the support member is removably attached to the vertical surface by stretch releasing adhesive tape.

8. The lifting apparatus of claim 1, wherein the lifting apparatus further comprises a handle for manually rotating the drive wheel.

9. The lifting apparatus of claim 1, wherein the lifting apparatus further comprises the segment of the toy track, and wherein the toy track defines a gap for receiving the carrier line.

10. The lifting apparatus of claim 1, wherein the drive wheel comprises a ratchet wheel, and the one-way clutch comprises a pawl.

11. A releasing apparatus for releasing a toy vehicle on a segment of a toy track, the segment having an upper end, the releasing apparatus comprising:

a carrier movable towards the upper end of the segment, and including a vehicle holder comprises a pair of calipers comprising opposed vehicle engagement surfaces, wherein the calipers are pivotable in relation to each other to vary the calipers between:

a vehicle-holding configuration in which the vehicle engagement surfaces clamp the toy vehicle between the vehicle engagement surfaces to hold the toy vehicle; and a vehicle-releasing configuration in which the vehicle engagement surfaces disengage from the toy vehicle to release the toy vehicle; and a stop structure attached to the toy track, and comprising at least one caliper-actuating member; and wherein, in use, when the carrier moves towards the upper end of the segment of the toy track relative to the stop structure, the at least one caliper-actuating member engages at least one of the calipers to urge the calipers from the vehicle-holding configuration to the vehicle-releasing configuration.

12. The releasing apparatus of claim 11, wherein the at least one caliper-actuating member comprises a pair of caliper-actuating members, and wherein, in use, each one of the caliper-actuating members engages a different one of the calipers to urge the calipers from the vehicle-holding configuration to the vehicle-releasing configuration.

13. The releasing apparatus of claim 11, wherein the toy vehicle comprises a pair of wheels, and wherein each of calipers defines a shoulder for engaging one of the wheels.

14. The releasing apparatus of claim 11, wherein the stop structure is translatable along the segment of the toy track to vary a position of the stop structure along segment of the toy track.

15. The releasing apparatus of claim 14, wherein the stop structure comprises a cam lever pivotable relative to segment of the toy track between:

a lock position in which the cam lever engages the toy track to prevent translation of the stop structure along the segment of the toy track; and an unlock position in which the cam lever disengages from segment of the toy track to allow translation of the stop structure along segment of the toy track.

16. The releasing apparatus of claim 15, wherein the stop structure comprises a key member movable relative to the cam lever between:

a lock position in which the key member interferes with the cam lever to prevent the cam lever from pivoting from the lock position to the unlock position; and an unlock position in which the key member permits the cam lever to pivot from the lock position to the unlock position.

17. The releasing apparatus of claim 11, wherein the releasing apparatus further comprises:

a drive wheel rotatable relative to the segment of the toy track;

a carrier line attached to the carrier and which is engageable with the drive wheel such that rotation of the drive wheel in a first drive wheel direction drives the carrier line to travel in a first carrier line direction so as to lift the carrier and the toy vehicle towards the upper end of the segment; and a one-way clutch that is positionable in a release position to permit the carrier line to move in the first carrier line direction so as to lift the carrier and the toy vehicle toward the stop structure, and is positionable in a holding position to resist movement of the carrier line in a second carrier line direction that is opposite to the first carrier line direction so as to hold the carrier against dropping.

18. The releasing apparatus of claim 17, wherein at least part of the drive wheel is disposed horizontally adjacent to the segment of the toy track.

* * * * *